US005938057A

United States Patent [19]

Cramer et al.

[11] Patent Number: 5,938,057

[45] Date of Patent: Aug. 17, 1999

[54] STEPPED-BOTTOM BASKET AND BASKET-MAKING METHOD

[75] Inventors: Kenneth J. Cramer, Coshocton; Hoy M. Cox, Millersburg; Christine A. Hudson, Coshocton; Leane M. LeFever, Frazeysburg, all of Ohio

[73] Assignee: The Longaberger Company, Dresden, Ohio

[21] Appl. No.: 08/583,247

[22] Filed: Jan. 5, 1996

[51] Int. Cl.[6] ..... B65D 8/04

[52] U.S. Cl. ..... 217/123; 217/122; 220/505

[58] Field of Search ..... 217/122, 123, 217/124, 125; 220/505, 494, 491, 485

[56] References Cited

U.S. PATENT DOCUMENTS

| | | | |
|---|---|---|---|
| 320,266 | 6/1885 | Maesel | 217/122 |
| 1,617,055 | 2/1927 | Jones | 217/122 |
| 1,926,785 | 9/1933 | Newhouse | 217/123 |
| 3,909,092 | 9/1975 | Kiernan | 220/505 |

FOREIGN PATENT DOCUMENTS

| | | | |
|---|---|---|---|
| 434359 | 2/1912 | France | 217/122 |
| 51876 | 3/1911 | Switzerland | 217/122 |

*Primary Examiner*—Stephen J. Castellano
*Attorney, Agent, or Firm*—Porter, Wright, Morris & Arthur

[57] ABSTRACT

A unitary basket having at least two bottom portions at different elevations that define deep and shallow basket portions. A plurality of upsplints form a wall of the deep portion and the bottom of the shallow portion, which extends transversely from the top of the wall. A weave strip positioned immediately below the basket bottom panel extends over the outer surface of the outermost upsplints in the wall panel. A short splint positioned adjacent to the wall panel extends over the outer surface of the outermost upsplints in the bottom panel. The consecutive oversplints urge the upsplints inwardly and upwardly to define a sharp angle between the wall and bottom panels. The method includes the steps of weaving the oversplints over the outermost upsplints in the wall and bottom panels.

8 Claims, 22 Drawing Sheets

STEPPED-BOTTOM BASKET AND BASKET-MAKING METHOD

BACKGROUND AND SUMMARY OF THE INVENTION

This invention relates generally to woven baskets having bottom portions at each of at least two different levels, such that their outer bottom portions may rest upon surfaces at different heights. Such baskets will be referred to as "stepped-bottom" baskets.

Stepped-bottom baskets are popular because they provide conveniently accessible storage for differently sized items. In a two-level basket, for example, the deeper portion may be used to hold larger items, such as reading materials and craft supplies, while the shallower portion may be used to hold smaller items, such as eyeglasses, pens, and scissors. A user seated in a chair easily may reach into a stepped-bottom basket placed alongside the chair to retrieve both the large and small items stored in the basket. Besides being used on flat surfaces for storing differently sized items, these baskets also may be placed on stairs, with the bottom of the deeper portion resting upon one stair tread and the bottom of the shallower portion resting upon the next higher stair tread, and used to assemble items to be taken up or down the stairs.

An intermediate wall separates the upper and lower bottom panels of the basket. Ideally, the transition from the intermediate wall to the upper bottom panel defines a substantially right angle. Commercially available stepped-bottom baskets seldom, if ever, achieve this ideal. These baskets tend to bow or sag in the transition area, giving the basket a sloppy appearance. These baskets also are likely to twist out of shape.

In light of the disadvantages of the prior art, a stepped-bottom basket is needed in which the angle defined by the transition from the intermediate wall to the upper bottom panel is sharp, and the intermediate wall and upper bottom panels remain straight and unbowed. A stepped-bottom basket also is needed that is resistant to twisting. A method for reliably producing baskets with these features is needed as well.

Accordingly, it is an object of the present invention to provide a stepped-bottom basket in which the angle defined by the transition from the intermediate wall to the upper bottom panel is sharp and the intermediate wall and upper bottom panels remain straight and unbowed. It is a further object of this invention to provide a stepped-bottom basket that is resistant to twisting. Finally, it is an object of this invention to provide a method for making such stepped-bottom baskets.

The foregoing objectives are achieved in a unitary basket having at least two bottom portions at different elevations. These bottom portions define deep and shallow basket sections. A plurality of upsplints form a wall of the deep section and the bottom of the shallow section, which extends transversely from the top of the wall. A horizontal weave strip is positioned immediately below the basket bottom panel and a short splint is positioned adjacent to the wall panel. The weave strip is woven over the outer surface of the outermost upsplints in the wall panel and the short splint is woven over the outer surface of the outermost upsplints in the bottom panel. The consecutive oversplints urge the upsplints inwardly and upwardly to define a sharp angle between the wall and bottom panels. The basket of the present invention does not bow or bulge outwardly in the transition area between the basket panels, and resists twisting out of shape. The method includes the steps of weaving the oversplints over the outermost upsplints in the wall and bottom panels.

These and further objects of the invention will become apparent from the following detailed description.

DETAILED DESCRIPTION OF THE PREFERRED EMBODIMENT(S)

The invention herein comprises a unitary basket having a stepped-bottom. The basket has at least two bottom portions at different levels. These bottom portions define basket sections of different depths. A plurality of upsplints form a wall of a deep section. The upsplints bend at the top of the wall to define the bottom of an adjacent shallow section, which extends transversely from the wall. The weave splints in each panel immediately adjacent to this bend are woven over the outermost upsplints in the panel. The consecutive oversplints urge the upsplints inwardly and upwardly to define a sharp angle between the wall and bottom panels.

Figure 1:
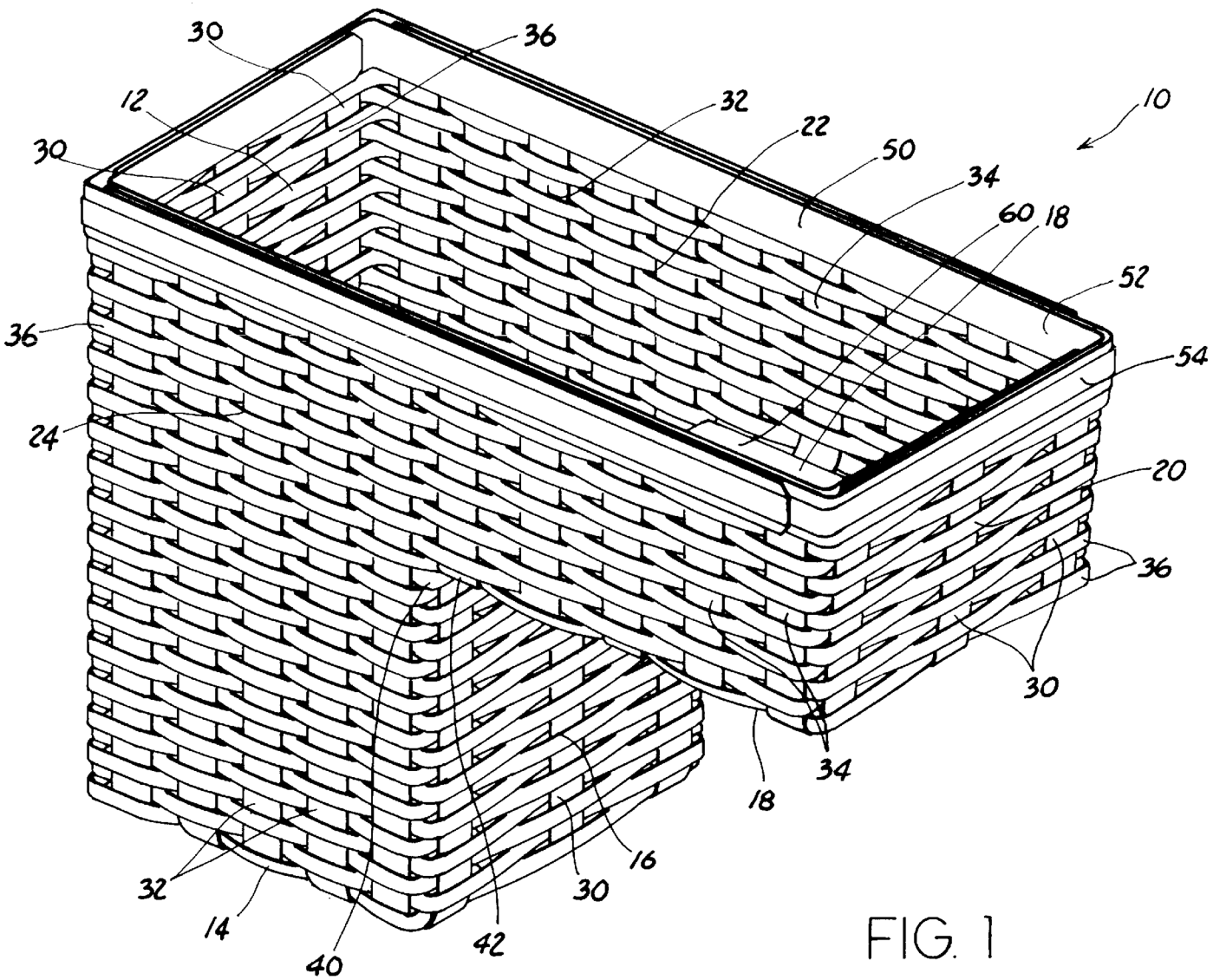
FIG. 1 is a right rear perspective view of an embodiment of the stepped-bottom basket of the present invention.
Figure 2:
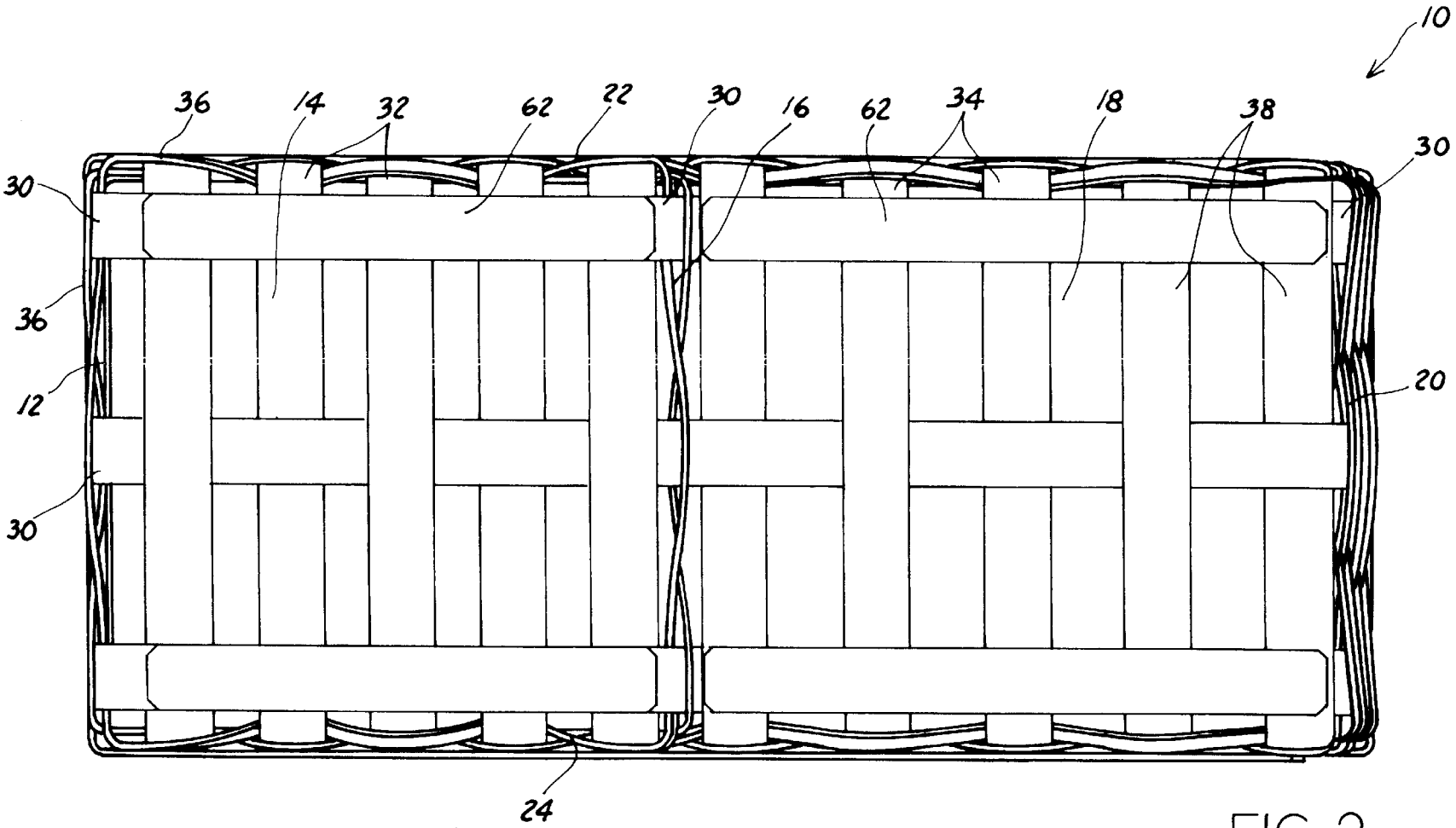
FIG. 2 is a bottom view of the basket of FIG. 1.
Figure 7:
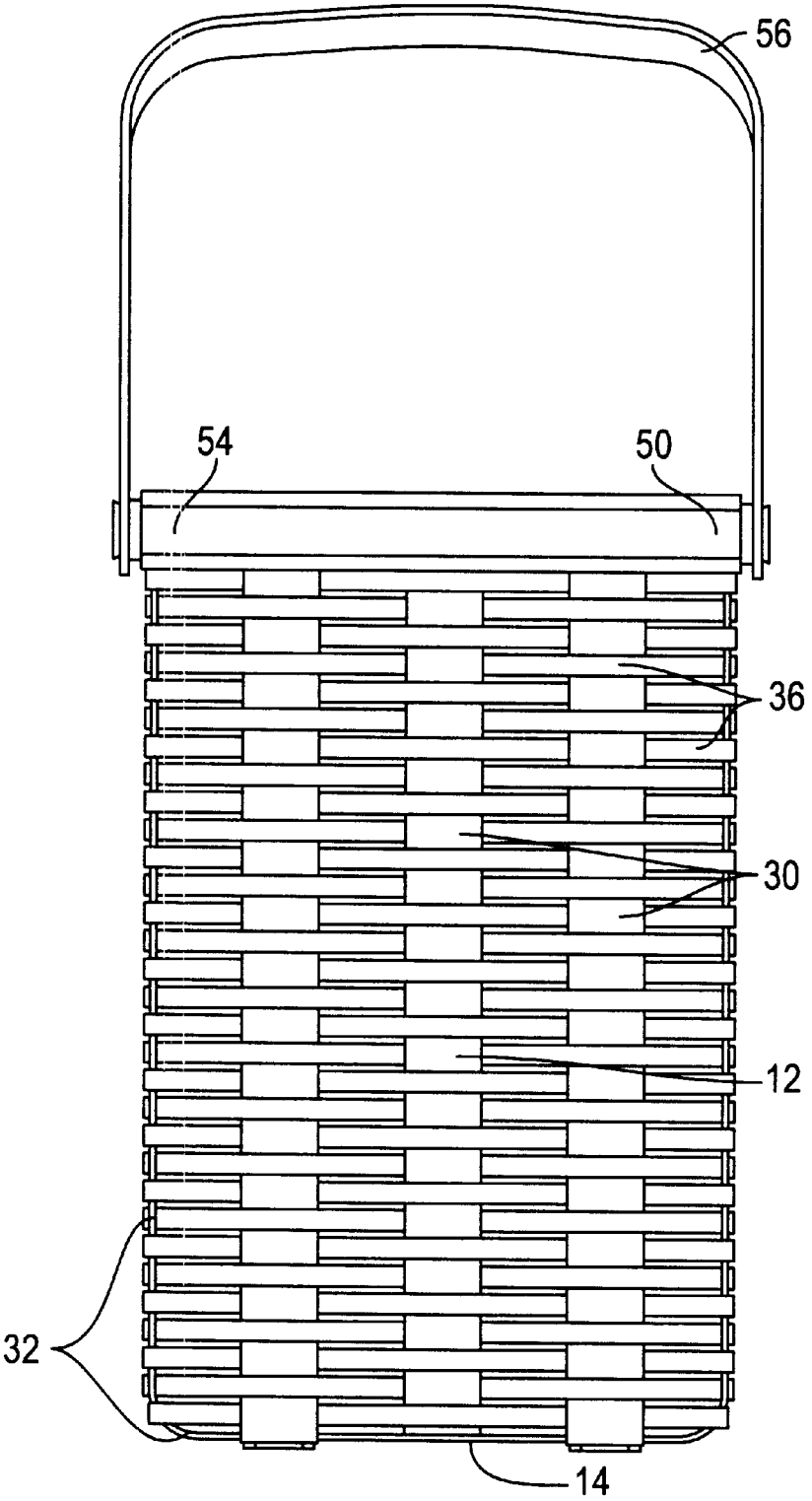
FIG. 7 is a front view of the basket of FIG. 5.
Figure 9:
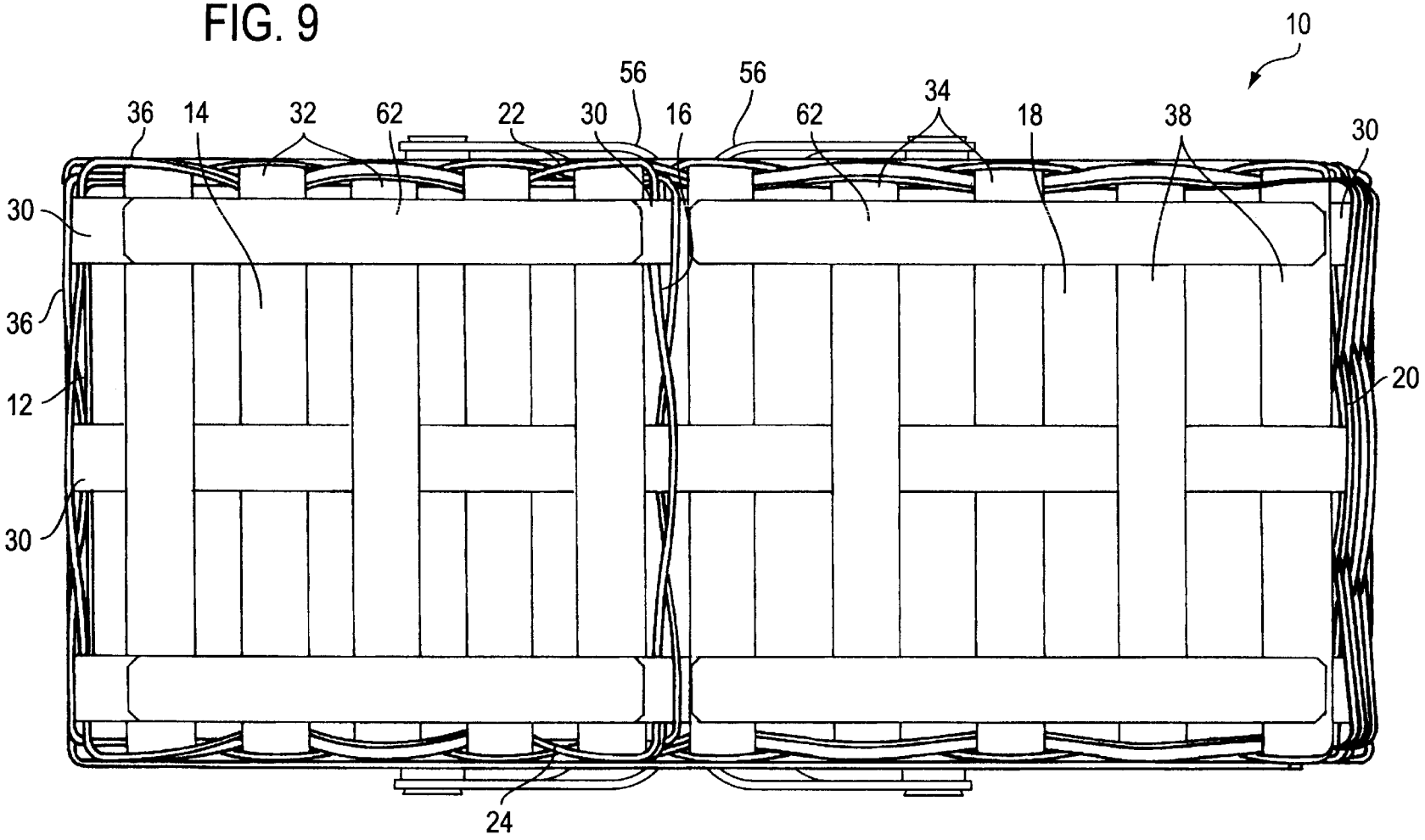
FIG. 9 is a bottom view of the basket of FIG. 5.

FIG. 1 shows a perspective view of a two-level embodiment of the basket of the present invention. The unitary basket 10 includes a substantially vertical front panel 12, best shown in FIG. 7. (The term "front" will be used to refer to the part of the basket that would be furthest from the stair risers if the basket was placed on stairs and the terms "upper rear" and "lower rear" will be used to refer to the parts of the basket that would be closest to higher and lower stair risers, respectively.) A lower bottom panel 14 (shown in FIGS. 2 and 9) extends transversely from the bottom of the front panel 12. The bottom panel 14 extends to the bottom of an intermediate or lower rear panel 16 which is located between the front panel 12 and an upper rear panel 20. The top of the lower rear panel 16 ends at a distance below the top of the front panel 12.

Figure 4:
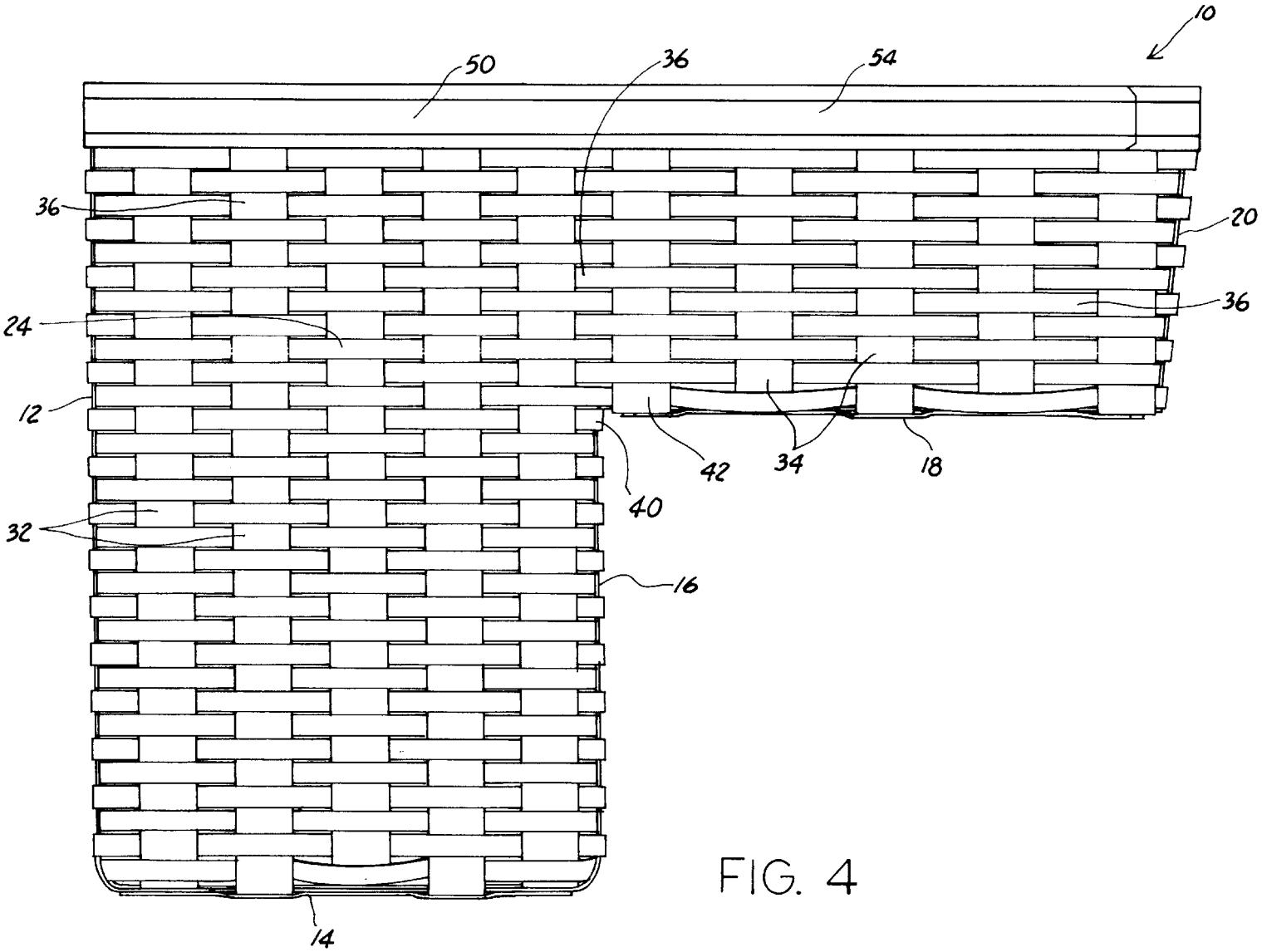
FIG. 4 is a right side view of the basket of FIG. 1, the left side being a mirror image thereof.
Figure 8:
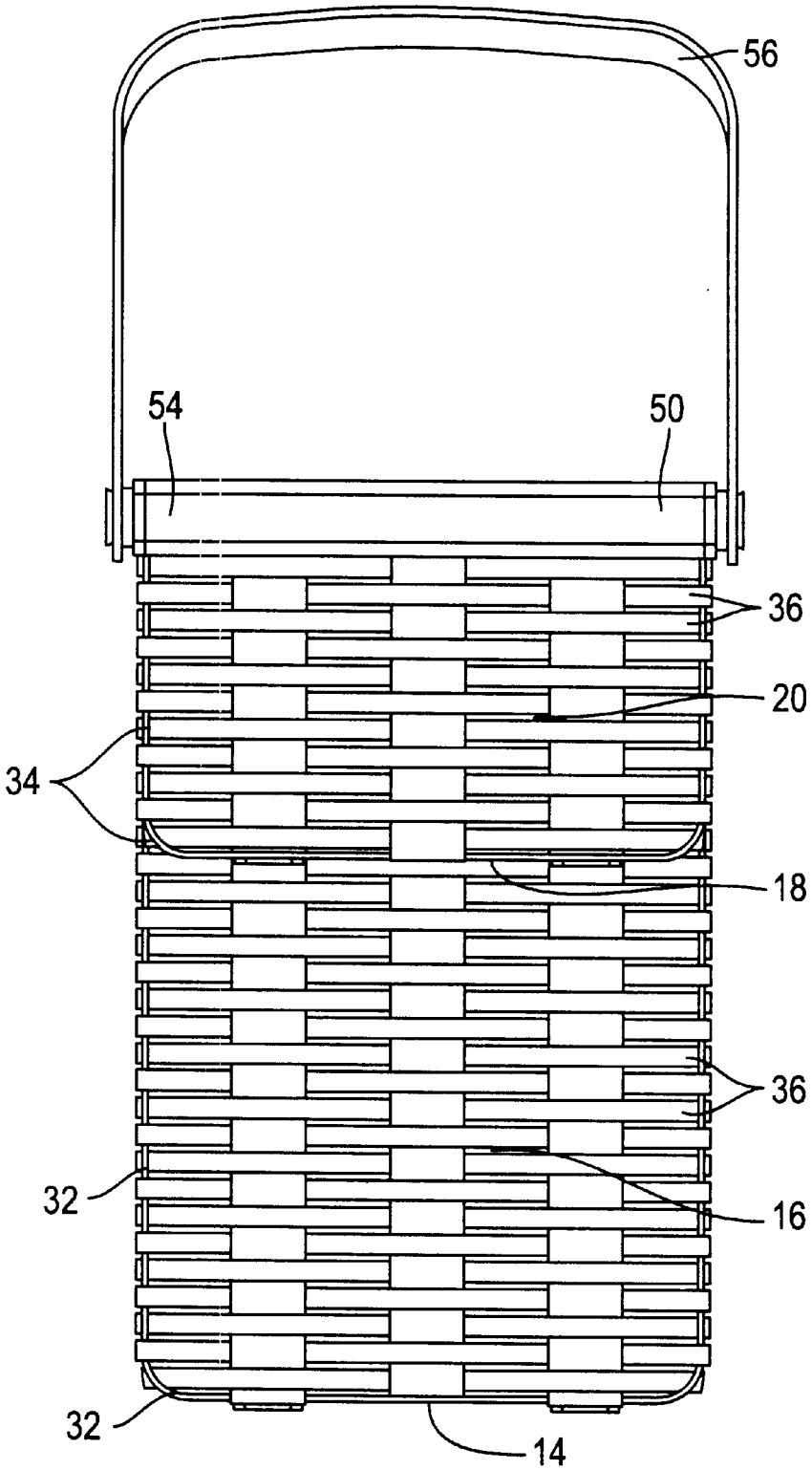
FIG. 8 is a rear view of the basket of FIG. 5.

An upper bottom panel 18 extends transversely from the top of the lower rear panel 16. The upper rear panel 20 (best shown in FIGS. 1 and 8) extends transversely from the opposite end of the upper bottom panel 18. The upper rear panel 20 is substantially parallel to the lower rear 16 and front 12 panels. Left 22 and right 24 side panels, best shown in FIGS. 4 and 6, each defines an inverted L-shape. The side panels 22, 24 extend laterally from the front panel 12 to the upper rear panel 20, in communication with the lower bottom panel 14, lower rear panel 16 and upper bottom panel 18.

The front panel 12, lower rear panel 16, and front portions of side panels 22, 24 define a deep front storage area while the upper rear panel and rear portions of side panels 22, 24 define a shallow rear storage area. The upper region of the front storage area is open to and integral with the rear storage area for greater storage flexibility.

The basket 10 is proportioned so that it can remain in an upright position when only the lower panel 14 is supported upon a surface, at least when the basket 10 is empty. If desired, however, the lower 14 and upper 18 bottom panels each may rest upon surfaces at different levels, such as successive stair treads or a floor and an adjacent raised ledge. The proportions of the basket 10 may be adjusted to be compatible with standard stair tread depths and riser heights, so that, for example, the upper 18 and lower 14 bottom panels both rest securely on their respective stair treads and the upper rear panel 20 fits against the stair riser beneath the nosing of the next higher stair tread.

The panels comprise thin flexible strips, such as wood splints. Upsplints 30 extend continuously from the top of the front panel 12, along the length of the lower bottom panel 14, up the lower rear panel 16, along the length of the upper bottom panel 18, to the top of the upper rear panel 20. The cross splints 32 extend from the top of the left side panel 22, along the width of the lower bottom panel 14 and to the top of the right side panel 24. Short splints 34 extend from the top of the left side panel 22, along the width of the upper bottom panel 18, to the top of the right side panel 24. Horizontal splints 36, referred to as weave strips, extend around the front, left, right and a rear panel of the basket 10 at predetermined distances from each other. Except as described below, the weave strips 36 generally are woven through the upsplints 30, cross splints 32, and short splints 34 in a conventional alternating over-and-under weave pattern.

The uppermost weave strip 36 that extends around the front 12, side 22, 24 and lower rear 16 panels just below the upper bottom panel 18 is referred to as the "weave strip oversplint" 40. The weave strip oversplint 40 crosses over the outer surface of the outermost upsplints 30 in the lower rear panel 16. The basket 10 of the present invention preferably has an odd number of upsplints 30 to facilitate this arrangement of the upsplints 30 and the weave strip oversplint 40 when the preferred over-and-under weave pattern is used. The basket shown in the drawing has three upsplints, but other odd numbers also will allow the weave strip oversplint 40 to be woven over the outermost upsplints 30 using the preferred weave pattern. It also may be possible to achieve satisfactory results with an even number of upsplints 30 if a different weave pattern is used.

The upsplints 30 in the lower rear panel 16 are bent transversely to the lower rear panel 16 just above the top of the weave strip oversplint 40. These upsplints 30 are woven with short splints 34 to form the upper bottom panel 18. The frontmost short splint 34, located nearest the lower rear panel 16, is referred to as the "short splint oversplint" 42. Like the weave strip oversplint 40, the short splint oversplint 42 crosses over the outer surface of the outermost upsplints 30 in the upper bottom panel 18.

Figure 11:
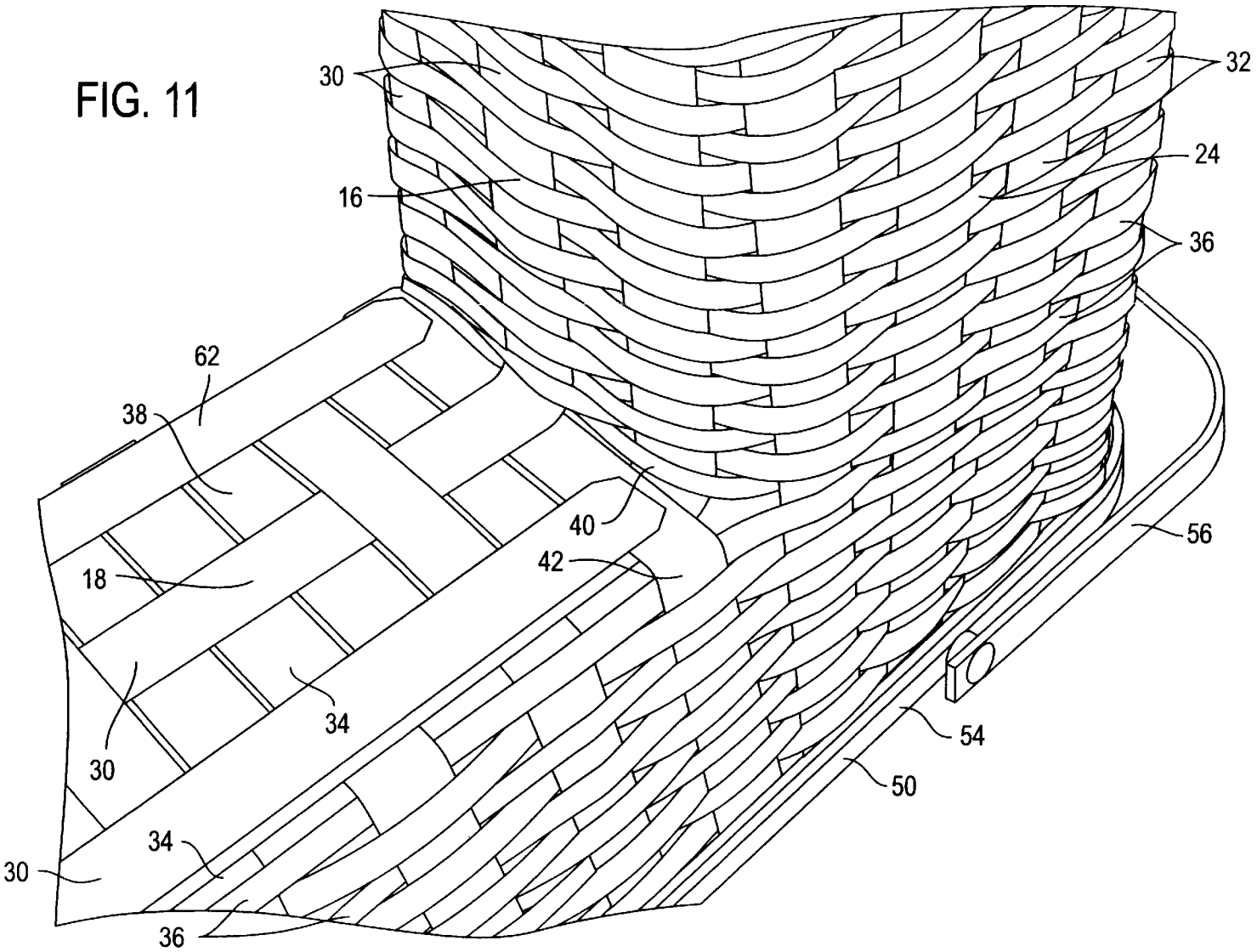
FIG. 11 is a partial detail view of the basket of FIG. 5, particularly illustrating the transition area between the lower rear panel wall and the upper bottom panel and the consecutive oversplint feature associated therewith.

FIG. 11 particularly illustrates this consecutive oversplint feature. The outermost upsplints in the lower rear panel 16 and upper bottom panel 18 are crossed over by two consecutive oversplints 40, 42. The oversplint 40 urges the outermost upsplints 30 inwardly and the oversplint 42 urges the outermost upsplints upwardly. This reduces bowing and sagging in the transition area between the panels 16, 18, and provides a sharp angle between the lower rear panel 16 and the upper bottom panel 18. The consecutive oversplints also reduce the tendency for the finished basket to twist out of shape. It is likely that the twisting tendency observed in baskets of conventional construction results from the asymmetrical forces exerted on the outermost upsplints in the transition area.

The stepped-bottom basket 10 may be constructed using the following steps:

(1) Forming the lower bottom panel 14;

(2) Constructing the lower rear panel 16 and the portions of the front 12, left 22 and right 24 panels that extend from the lower bottom panel 14 to the upper bottom panel 18, including the step of providing a weave strip outersplint that crosses over the outer surface of the outermost upsplints 30 in the lower rear panel 16;

(3) Forming the upper bottom panel 18 from the upsplints 30 in the lower rear panel 16, including the step of providing a short splint outersplint that crosses over the outer surface of the outermost upsplints 30 in the upper bottom panel 18; and (4) Constructing the upper rear panel 20 and the remainder of the front 12, left 22 and right 24 panels from the upper bottom panel 18 to the basket rim 50.

Figure 12:
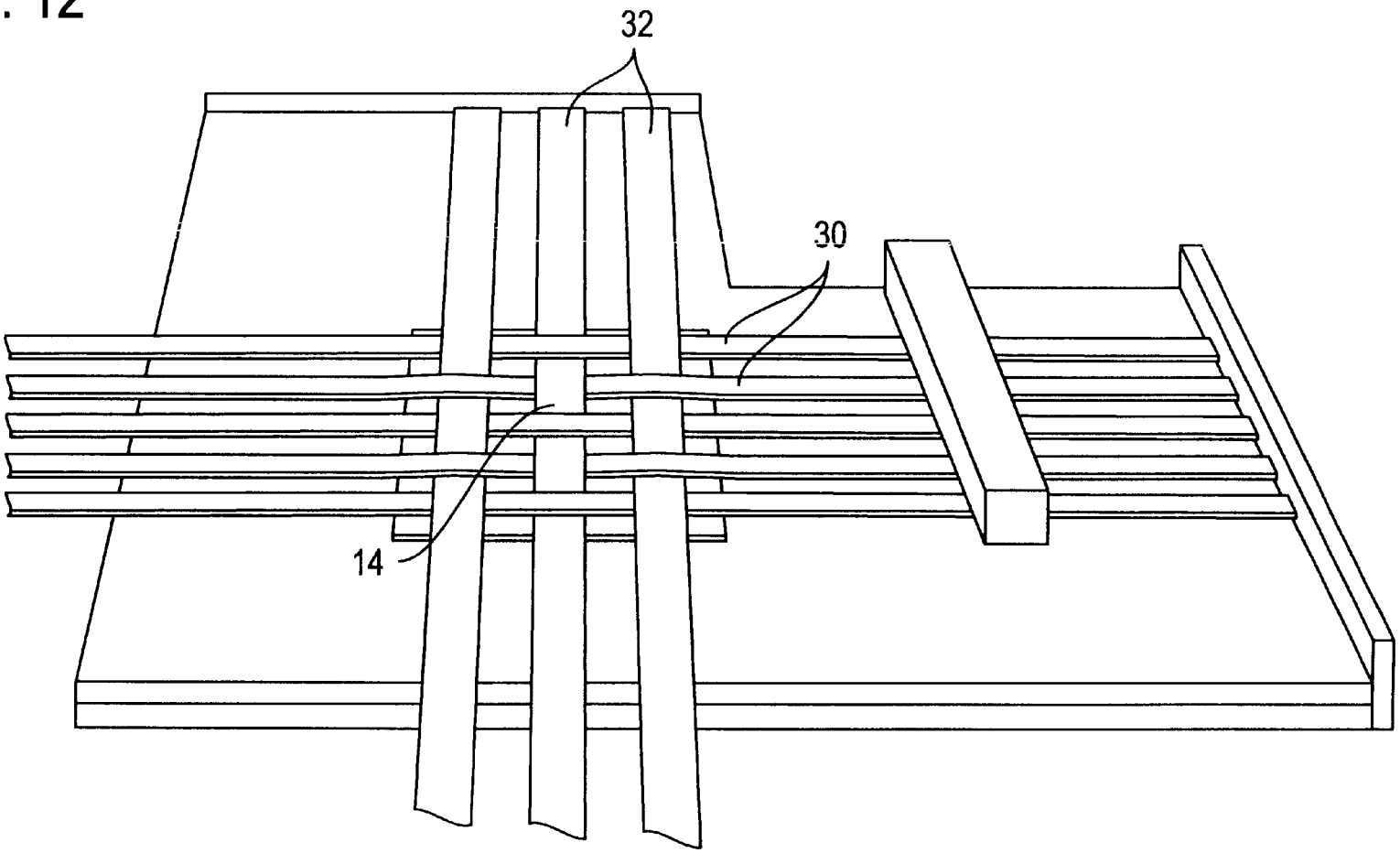
FIG. 12 is a view of a lower bottom panel being constructed according to the method of the present invention.

More specifically, the basket 10 may be constructed by first forming the lower bottom panel 14 as shown in FIG. 12. Construction of this panel 14 is similar to construction of the bottom panel of a conventional rectangular splint basket. The bottom panel 14 is formed by weaving cross splints 32 through an array of upsplints 30 to define a central woven section with the splints ends extending outwardly therefrom. The cross splints 32 that extend outwardly from the woven section will form the vertical framework of the side panels 22, 24 of the deep front portion of the basket 10, so they must be at least as long as the desired basket height (from the lower bottom panel 14 to the top rim 50) plus the width of the lower bottom panel 14. The upsplints 30 that extend outwardly from the woven section will form the vertical framework of the front 12 and upper 20 and lower 16 rear panels of the basket, and the base of the upper bottom panel 18. The upsplints 30 therefore must be at least as long as the sum of twice the desired basket height and the combined lengths of the upper 18 and lower 14 bottom panels.

Figure 3:
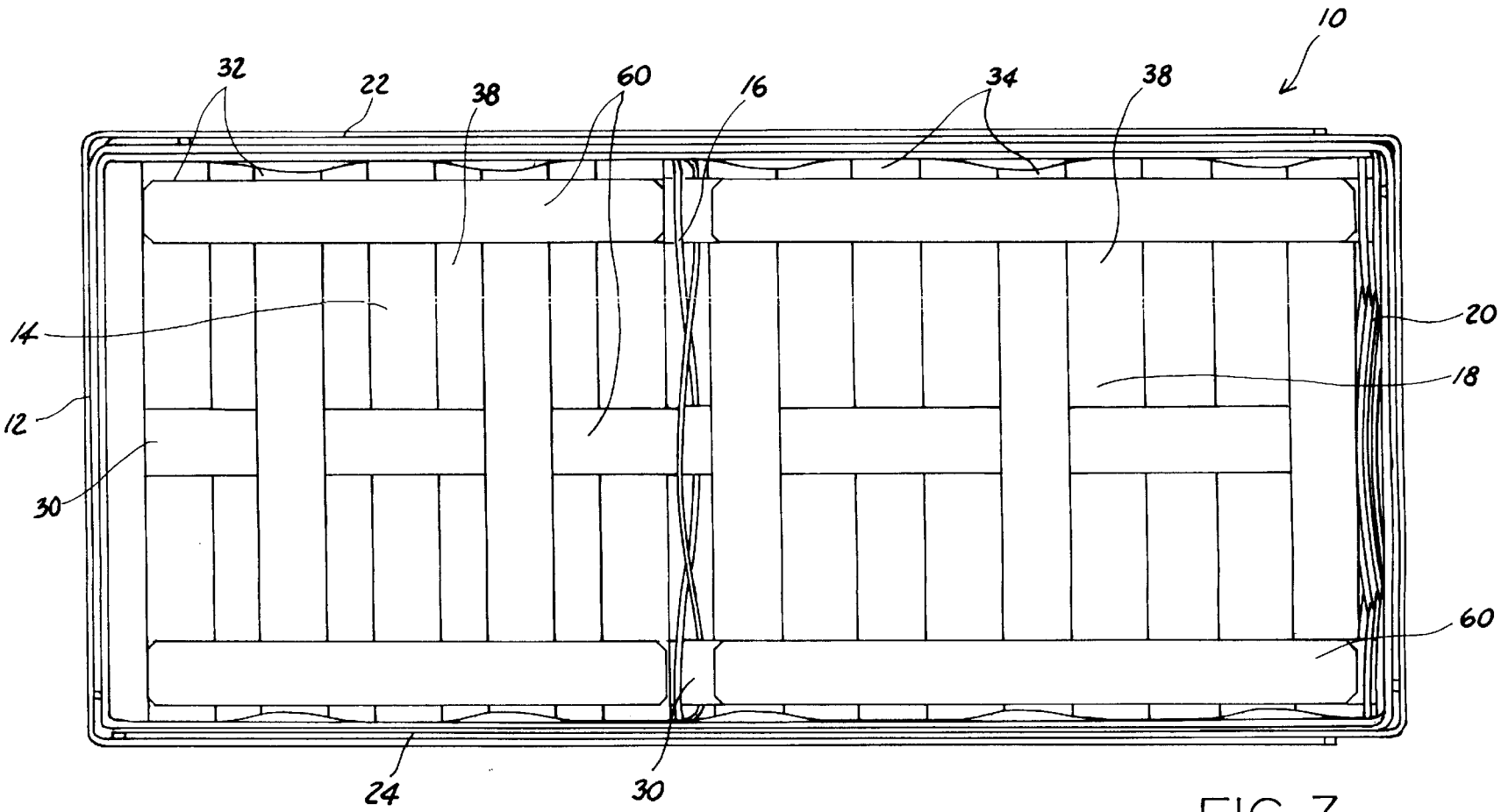
FIG. 3 is a top view of the basket of FIG. 1.
Figure 10:
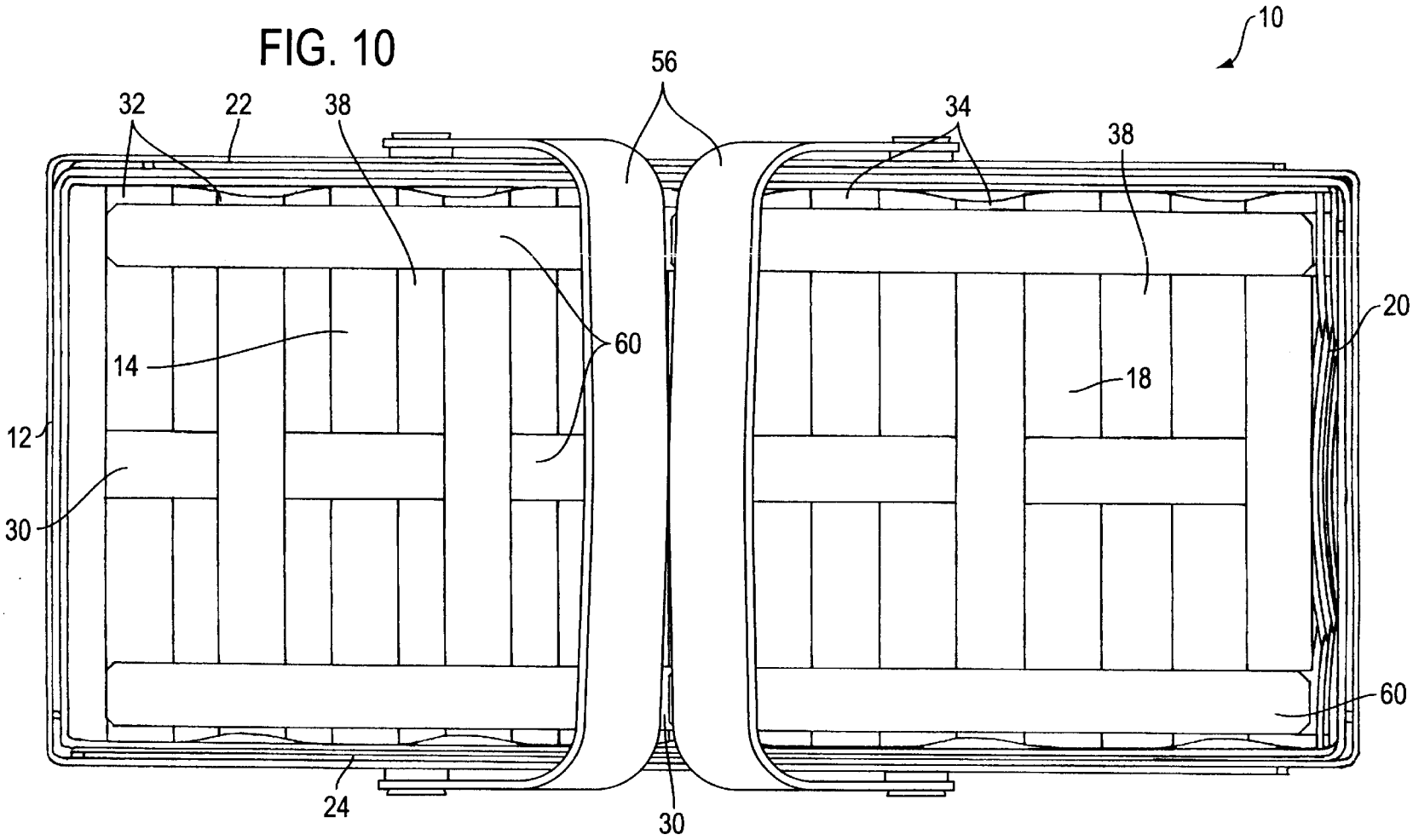
FIG. 10 is a top view of the basket of FIG. 5.

As explained further below, the bottom panel 14 may include inner 60 or outer 62 reinforcements, or both, if desired. These reinforcements provide a finished appearance and increase the strength of the bottom panel 14. Inner reinforcements 60, shown in FIGS. 3 and 10, are positioned on the work surface before forming of the bottom panel 14 begins. Recessed slots may be provided in the work surface to prevent the inner reinforcements 60 from sliding out of place. Upsplints 30 are arranged on the work surface over the inner reinforcements 60, in spaced parallel relationship to one another. As described above, an odd number of upsplints 30 preferably is selected. A weighted bar, shown in FIG. 12, may be placed over an end of the upsplints 30 to hold them in place during weaving of the cross splints 32. Fill splints 38, which do not extend beyond the edges of bottom panel, may be arranged between the upsplints 30 to reduce the openness of the bottom panel 14.

Cross splints 32 are woven through the parallel upsplints 30 and fill splints 38 in a desired pattern, with an alternating, over-and-under pattern being preferred. A double thickness of cross splints 32 and upsplints 30 may be used to increase the strength and rigidity of the finished basket 10 without sacrificing flexibility during weaving. The first cross splint 32 generally is spaced at a distance from the front panel 12 end of the upsplints 30 that is about equal to the desired basket height. This will cause the woven panel 14 to be located asymmetrically with respect to the upsplints 30, with the upsplints 30 extending beyond the opposite side of the finished panel 14 being about as long as the desired height of the basket plus the combined lengths of the upper 18 and lower 14 bottom panels. Additional cross splints 32 are woven though the upsplints 30 until the desired number of cross splints 32 in the lower bottom panel 14 is reached.

Outer reinforcements 62 (shown in FIGS. 2 and 9) may be positioned on the exterior of the woven bottom panel 14, usually overlaying the upsplints 30 and any inner reinforcements 60. The outer reinforcements 62 are secured to the splints in the bottom panel 14 and any underlying reinforcements 60, preferably by fasteners, such as tacks.

Figure 18:
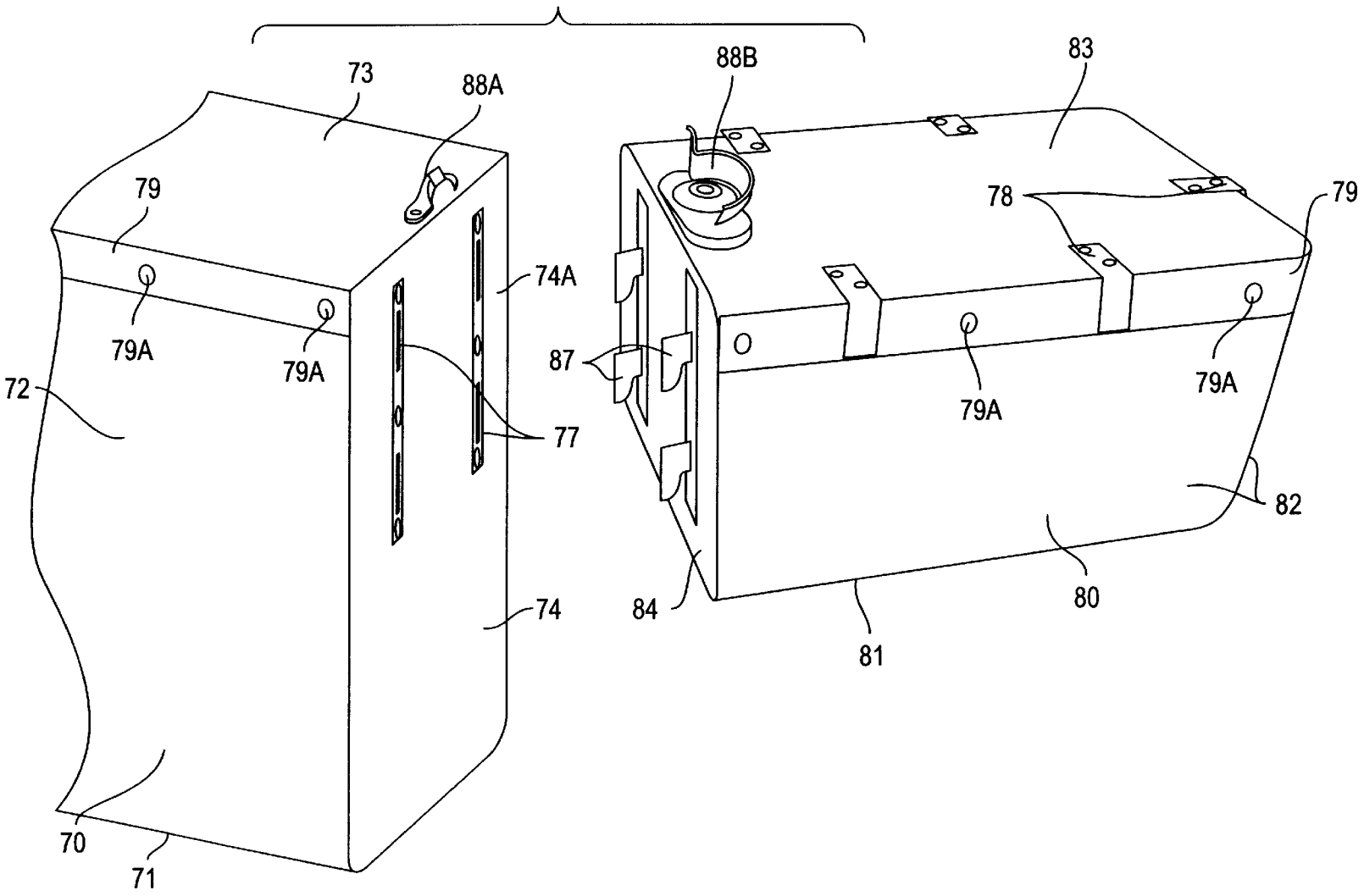
FIG. 18 is a side view of the first and second mold segments, showing the connectors used to secure the mold segments together to form the combined mold.

The remainder of the basket 10 is constructed using a basket mold 68. For ease in weaving, the basket mold 68 may be partitioned into detachably connected segments 70, 80, as shown in FIGS. 18 and 21A. The first mold segment 70 defines the shape of the interior of the deep, front section of the basket 10. The first segment 70 initially is used alone to form the portions of the front 12, left 22 and right 24 panels that extend from the lower bottom panel 14 to the upper bottom panel 18. The second mold segment 80 defines the shape of the interior of the shallow rear section. The second mold segment 80 is connected to the first segment 70 for use in forming the upper bottom panel 18, the upper rear panel 20 and the remainder of the front 12 and side 22, 24 panels. The particulars of the basket mold 68 are described further below.

Figure 13:
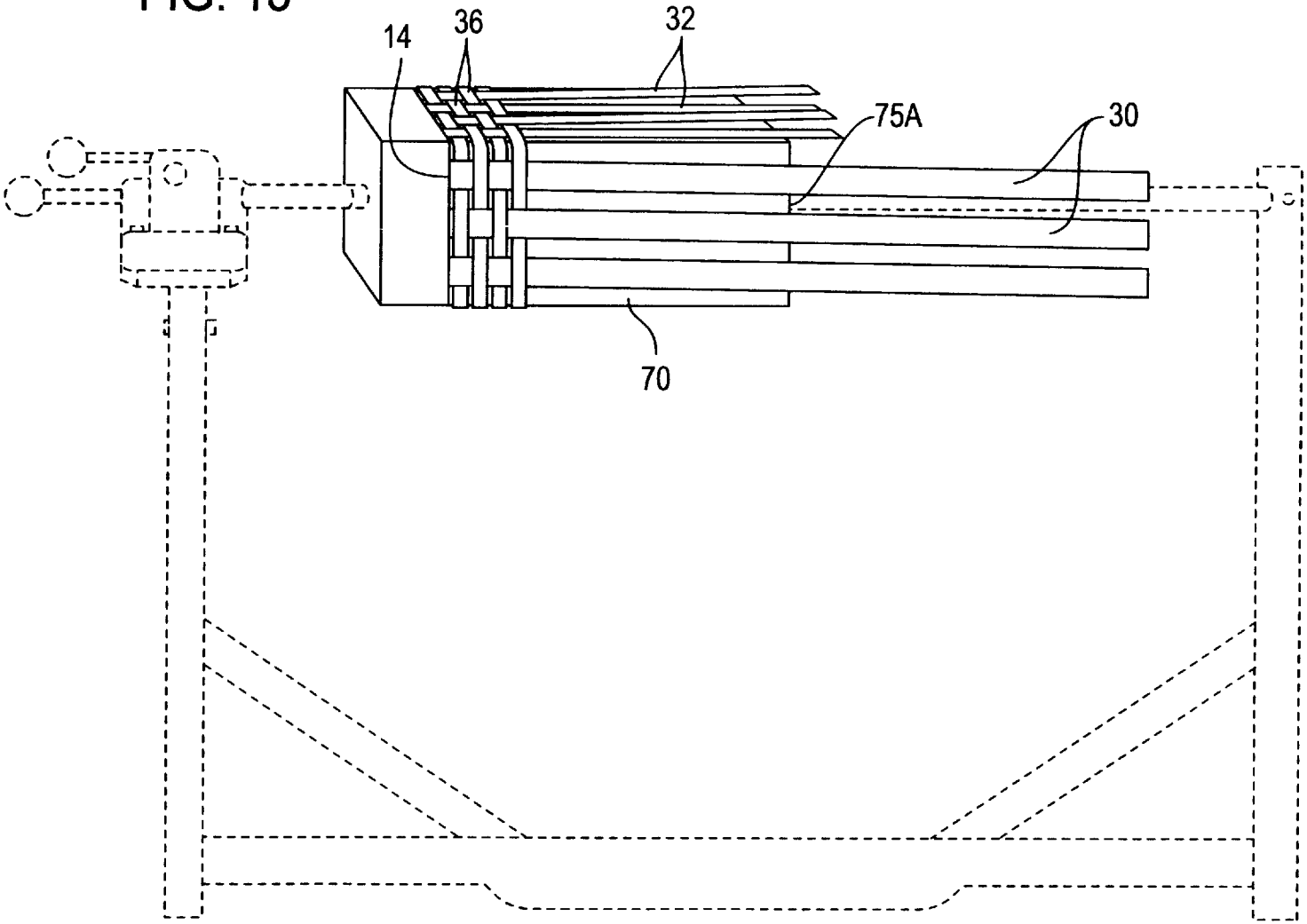
FIG. 13 is a view of the lower front and left side panels being constructed according to the method of the present invention, and showing the lower bottom panel clamped to a first basket mold supported on a weaving horse.

As shown in FIG. 13, the lower bottom panel 14 is overlaid on the top 71 of the first mold segment 70, which is shown supported on a weaving horse in FIG. 13. The formed panel 14 is secured to the mold 70 by a conventional "hold-down" or clamp. The upsplints 30 and cross splints 32 are bent to conform them to the sides 72 of the mold 70. The ends of the upsplints 30 corresponding to the upper bottom panel 18 and the upper rear panel 20 extend a distance beyond the mold bottom 73.

Weave strips 36 are woven through the splints 30, 32 in any desired pattern, with an alternating, over-and-under pattern being preferred. These weave strips 36 will form the cross-weaving, or horizontal structure, of the finished basket 10. As with the cross splints 32 and upsplints 30, a double thickness of weave strips 36 may be used. Successive rows of weave strips 36 are added until the basket panels reach a height slightly less than the desired height of the lower rear panel 16. The size, number and arrangement of weave strips 36 are selected so that the uppermost weave strip comprises the weave strip oversplint 40 described above, and crosses over the outer surface of the outermost upsplints 30 in the lower rear panel 16. The selection of an odd number of upsplints 30 facilitates this arrangement of splints when the preferred over-and-under weave pattern is used.

Figure 14:
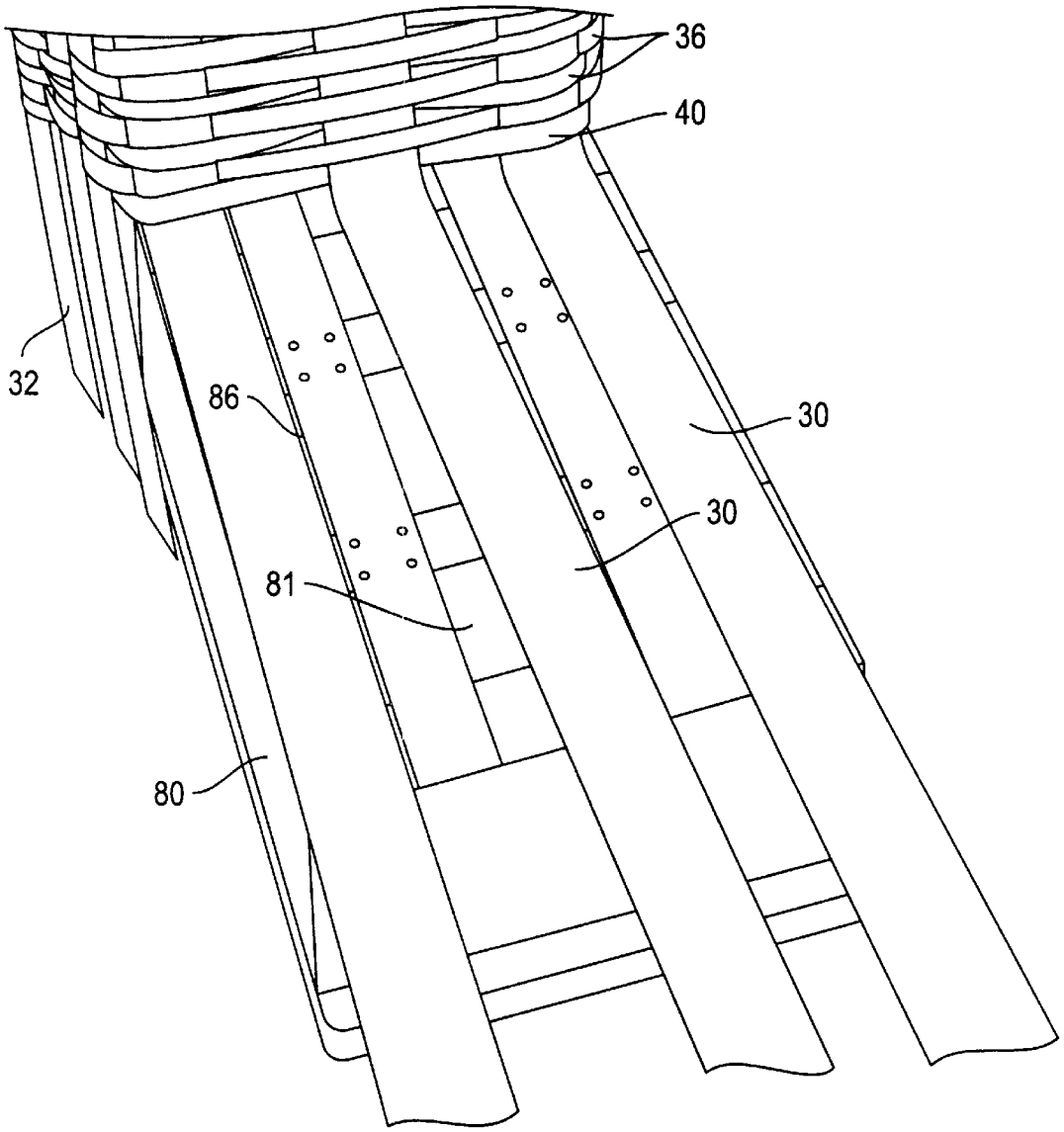
FIG. 14 is a view of the upsplints bent over the top of the second basket mold to form the upper bottom panel according to the method of the present invention.

After the weave strip oversplint 40 is incorporated into the basket, the second mold segment 80 may be connected to the first segment 70, as shown in FIG. 14, in preparation for forming the upper bottom panel 18. If desired, the placement of the combined mold 68 on the weaving horse may be adjusted to accommodate the new center of gravity of the combined mold 68. The top 81 of the second mold segment 80 preferably includes an integral guide (shown in FIGS. 14 and 20E) for holding the inner reinforcements 60 of the upper bottom panel in position on the mold 80.

The upper bottom panel 18 is formed by placing inner reinforcements 60 on the top of the second mold segment 80, preferably using the integral guide slots 86 to keep the reinforcements 60 from sliding out of position. The upsplints 30 from the lower rear panel 16 are bent at about a right angle so that they extend across the top of the second mold segment 80 (and over the inner reinforcements 60). Fill splints 38, which do not extend beyond the edges of upper bottom panel 18, may be arranged between the upsplints 30 to reduce the openness of the upper bottom panel 18.

Figure 15:
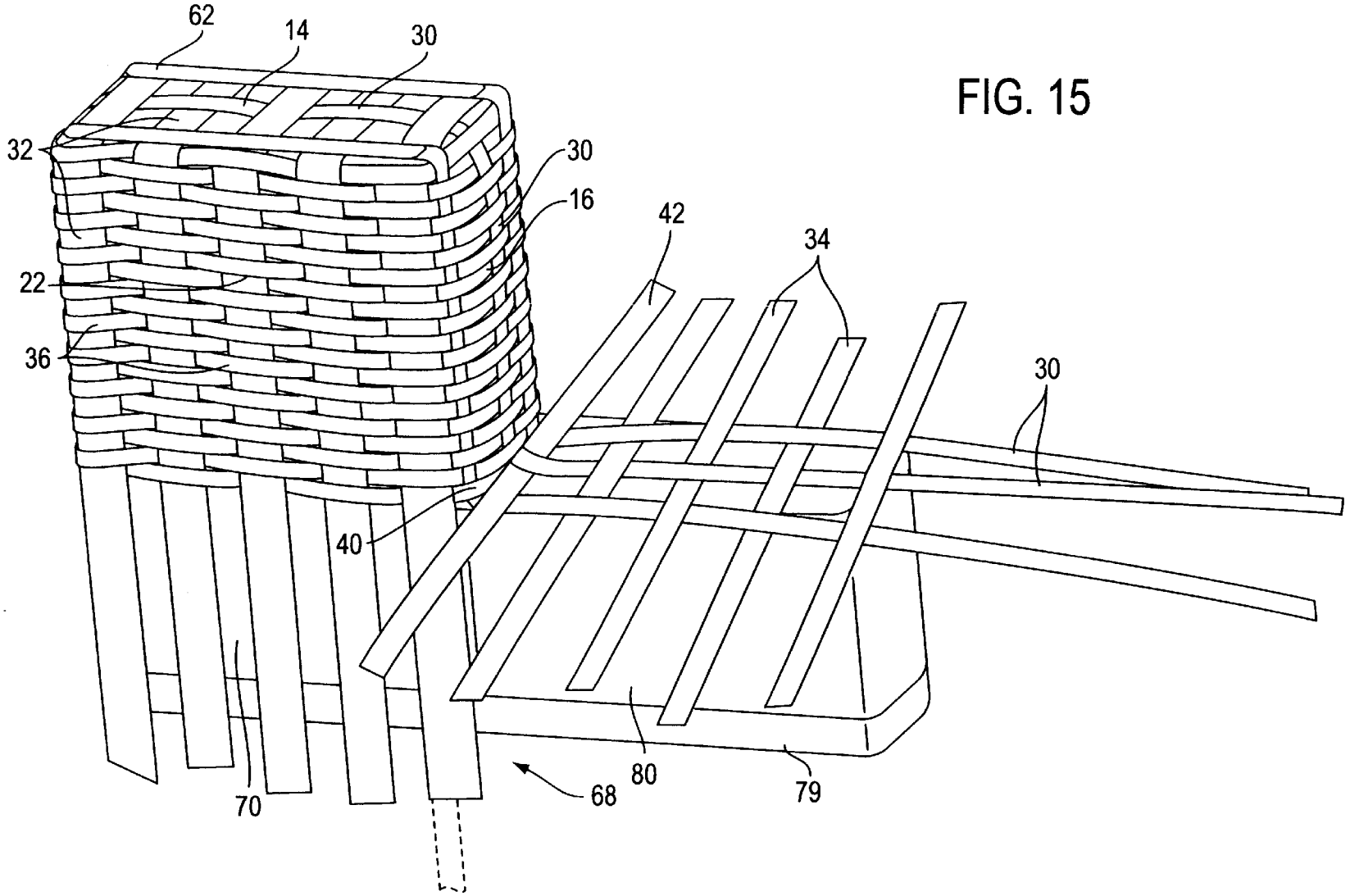
FIG. 15 is a view of the short splints woven through the upsplints of the upper bottom panel according to the method of the present invention.

Short splints 34, which will form the vertical structure of the shallow rear portion of the basket 10, are woven through the upsplints 30 and fill splints 38, as shown in FIG. 15. The short splint 34 closest to the front panel 12 and the lower rear panel 16, namely, short splint oversplint 42, is woven over the outer surface of the outermost upsplints 30 in the upper bottom panel 18. The remaining short splints 34 are woven through the upsplints 30 and fill splints 38 in any desired pattern, with an alternating, over-and-under pattern being preferred. Outer reinforcements 62 may be positioned over the upsplints 30 and secured to the splints and inner reinforcements of the upper bottom panel 18 as described above.

Use of short splints 34 and cross splints 32 of equal widths may enhance the appearance of the basket. Spacing the cross splints 32 and the short splints 34 a uniform distance from one another also may enhance the appearance of the basket, although this may not be practical if the basket is proportioned for use on stairs.

It is emphasized that in constructing the stepped-bottom basket 10 of the present invention, the outermost upsplints 30 in the lower rear panel 16 and upper bottom panel 18 are crossed by two consecutive oversplints—the uppermost weave strip 40 in the lower rear panel 16 and the frontmost short splint 42 in the upper bottom panel 18. This consecutive oversplint feature is not present in baskets that employ the customary alternating, over-and-under weave pattern. This change from the customary alternating weave pattern results produces an unexpectedly superior basket, with flat lower rear 16 and upper bottom 18 panels, a sharp angle between these panels, and good resistance to twisting.

Figure 16:
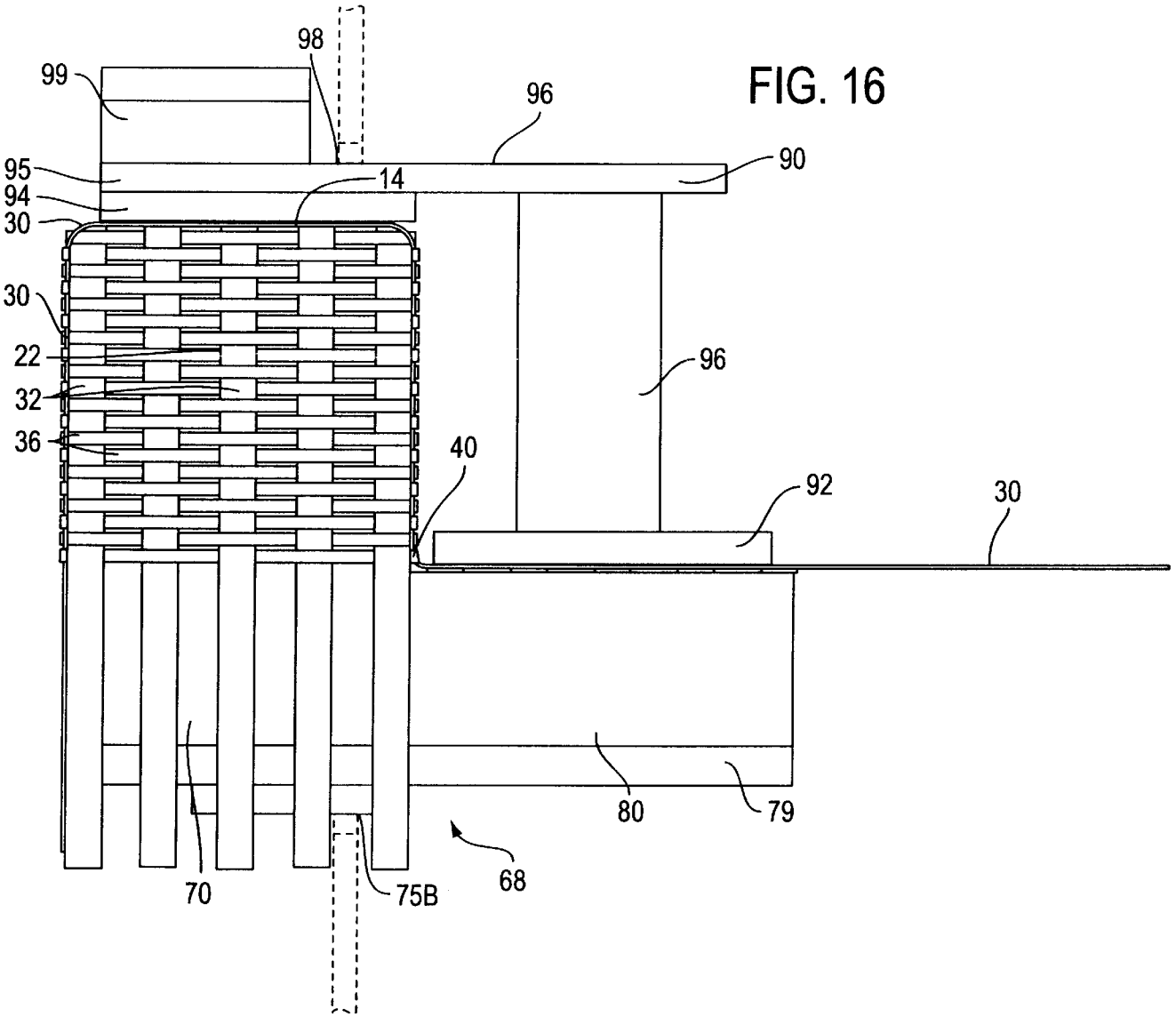
FIG. 16 is a view of the lower and upper bottom panels being secured to the combined mold by a clamp according to the method of the present invention.
Figure 22B:
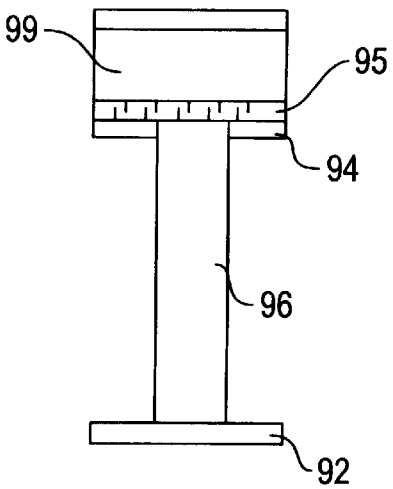
FIG. 22B is a rear view of the hold-down of FIG. 22A.
Figure 22C:
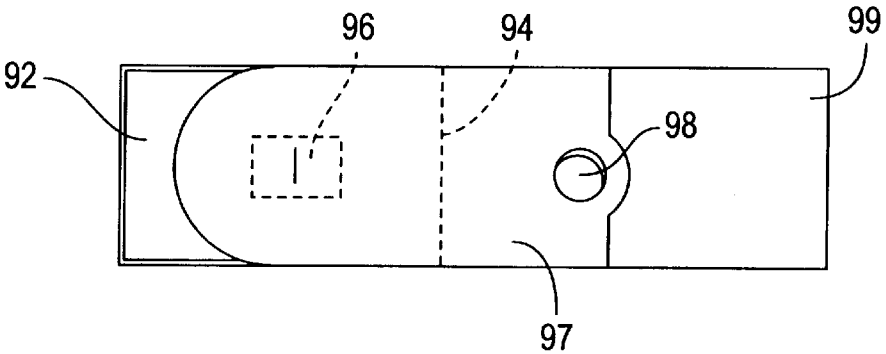
FIG. 22C is a top view of the hold-down of FIG. 22A.
Figure 22A:
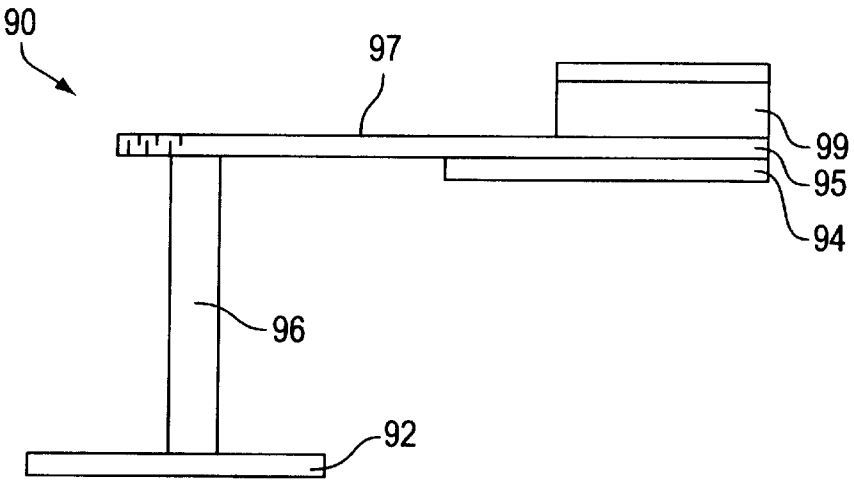
FIG. 22A is a side view of the hold-down device used to secure the basket bottom panels to the mold of FIG. 21A.

After the upper bottom panel 18 has been formed, it is secured to the second mold segment 80 by a "hold-down" or clamp, shown in FIGS. 22A through 22C. Preferably, the conventional hold-down used to secure the lower bottom panel to the first mold segment 70 is removed and an L-shaped hold-down 90, best shown in FIGS. 16 and 22A, is used to secure both the upper 18 and lower 14 bottom panels to the combined mold 68. The hold-down 90 defines parallel plates 92, 94 that press the upper 18 and lower 14 bottom panels, respectively, against the mold 68. The plates 92, 94 are connected by an arm 95 extending from plate 94 toward plate 92, and a spacer 96 between arm 95 and plate 92. A recess 98 (shown in FIG. 22C) may be provided in the upper surface 97 of the arm 95 for securing the hold-down 90 to a weaving horse. A weight block 99 may be provided on the arm 95 to control the rotation of the combined mold 68 and hold-down assembly on the weaving horse.

Figure 17:
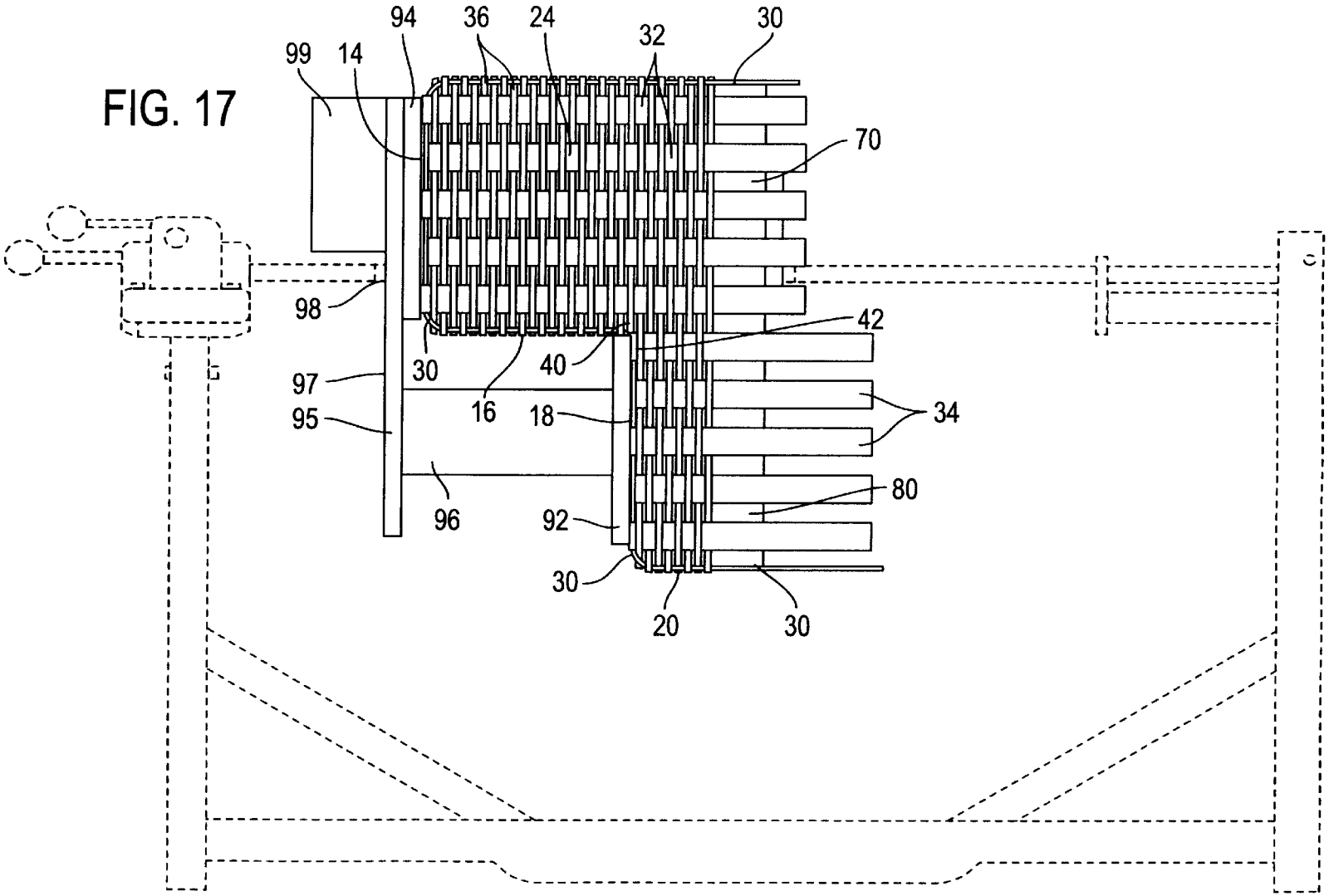
FIG. 17 is a view of the front and right side panels being constructed according to the method of the present invention.

The upsplints 30 and short splints 34 extending beyond the borders of the upper bottom panel 18 are bent and shaped around the second mold segment 80, with the short splints 34 arranged substantially parallel to the cross splints 32 of the deep portion. An inner top band 52 may be secured by guides 78 provided along the bottom of the combined mold 68 before construction of the remainder of the basket panels begins (shown in FIGS. 21A and 21B). FIG. 17 shows an inner top band secured in this position by guides 78.

Weave strips 36 are woven through the cross splints 32 and short splints 34 that collectively define the upper left 22 and right 24 panels and the upsplints 30 that define the front 12 and upper rear 20 panels. Any desired weave pattern may be used, with an alternating, over-and-under pattern being preferred. Successive rows of weave strips 36 are added until the panels reach a desired height. The appearance of the basket may be enhanced by using weave strips of the same width as those used in the lower portion of the basket, and maintaining a uniform distance between the weave strips 36 in the upper portion and those in the lower portion.

When weaving is complete, the ends of the splints 30, 32, 34 may be trimmed to a substantially uniform height that is slightly shorter than the desired height of the finished basket. The upper rim of the basket 10 is finished by securing the upper splint ends to a top band 50. Preferably, an inner top band 52 and an outer top band 54 are used to create a finished appearance and provide a stronger basket. When both inner 52 and outer 54 top bands are used, the splints 30, 32, 34 are sandwiched between the inner band 52 (which is held in position against the mold by guides 78 along the bottom of the combined mold 68 as shown in FIG. 17) and the outer band 54. Preferably, the splints are secured to the band(s) with fasteners such as tacks, although other securing methods, such as rivets or adhesives, also may be used. The basket will have greater structural integrity and durability if each splint is secured to the band, but it may still perform its desired functions if one or more of the splints remains unsecured. The end of the outer top band 54 preferably is located on a side 22, 24 of the basket near the upper rear panel 20. This gives the front of the basket a cleaner appearance and positions the outer band end near the rear of the basket, reducing the likelihood that items will catch on the band end if the basket is placed on stairs. If it is necessary to form the outer top band 54 in two pieces, both ends preferably will be located on a basket side 22, 24 near the upper rear panel 20.

Figure 5:
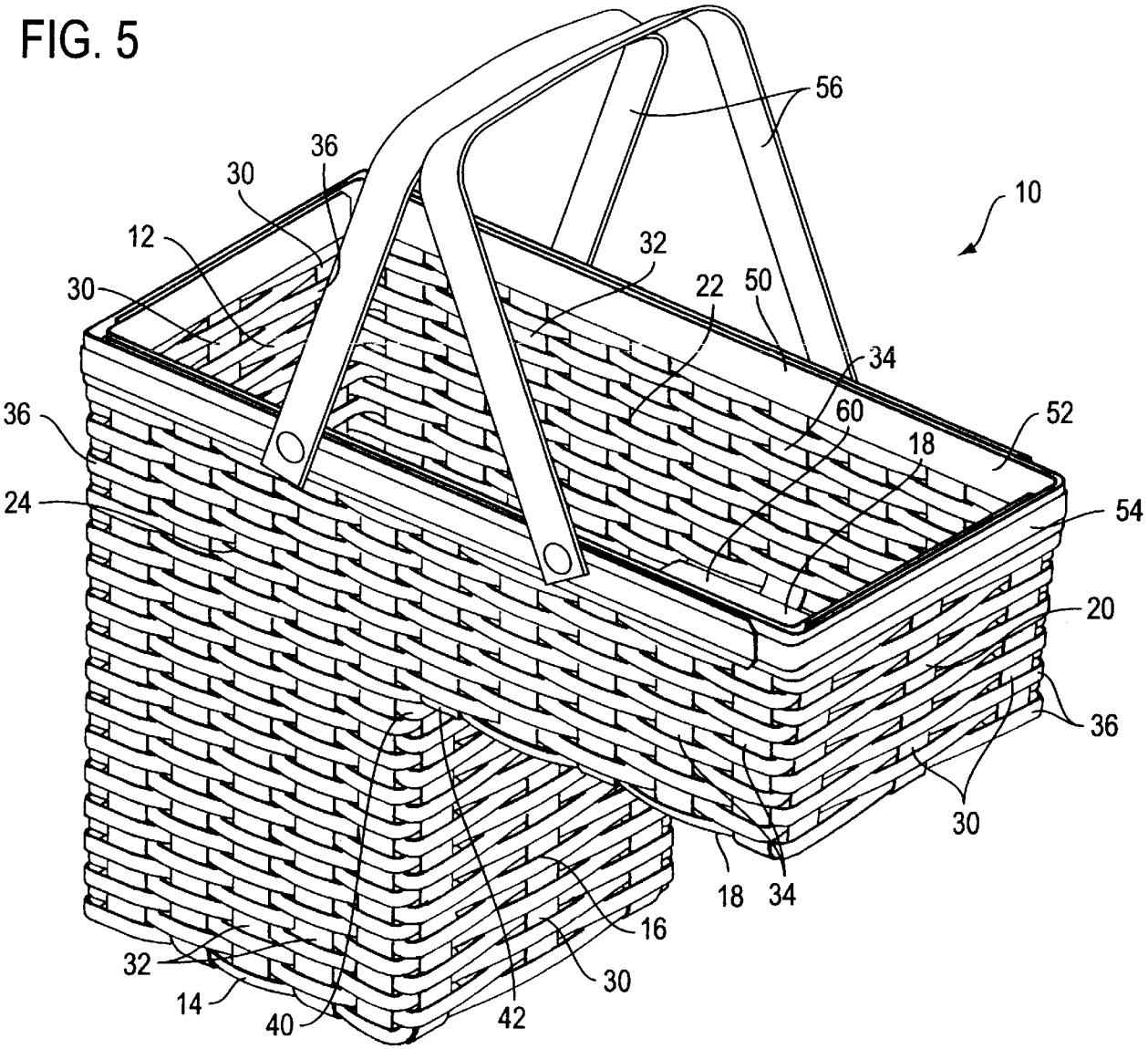
FIG. 5 is a right rear perspective view of another embodiment of the basket of the present invention.
Figure 6:
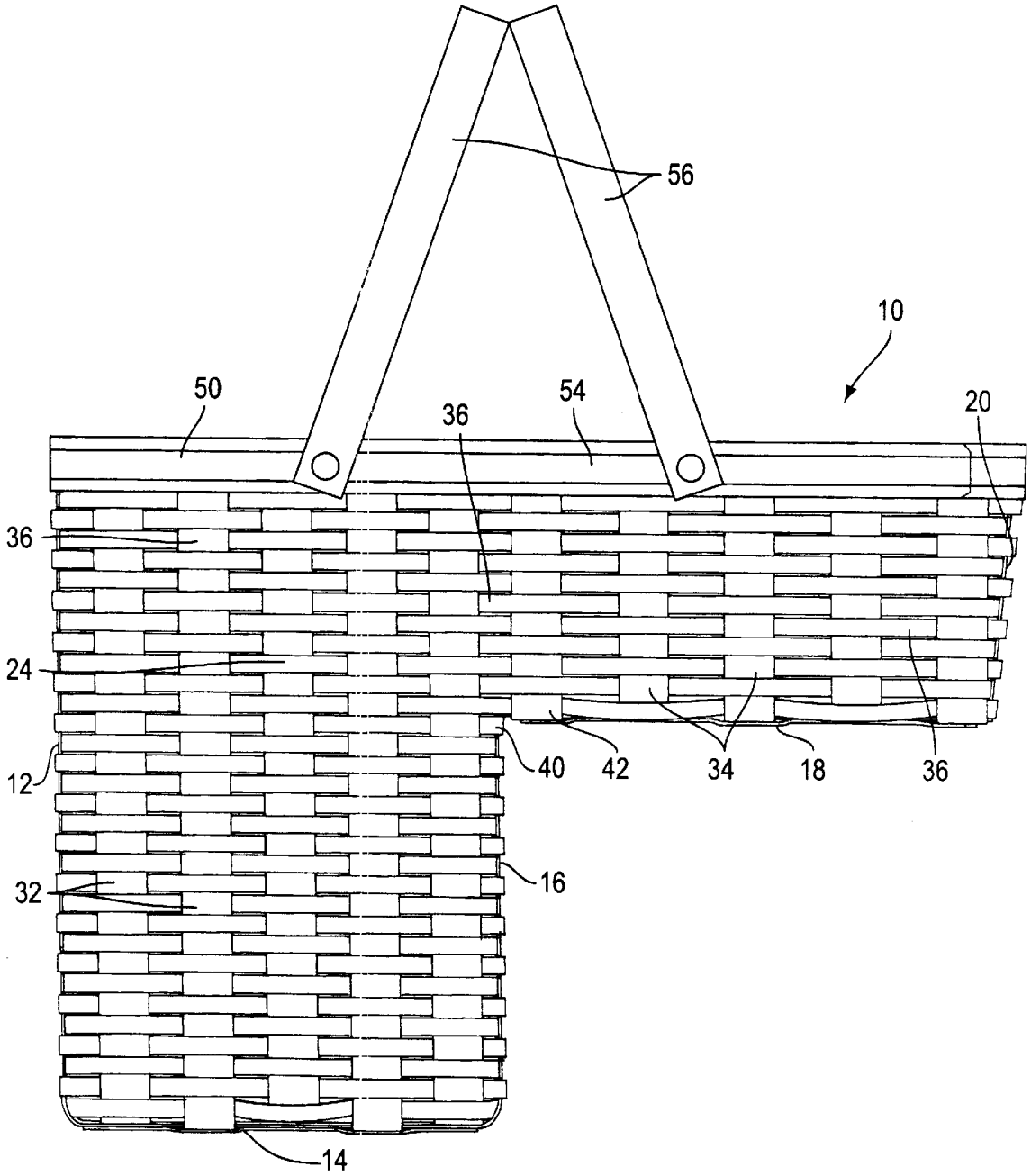
FIG. 6 is a right side view of the basket of FIG. 5, the left side being a mirror image thereof.

One or more handles may be secured to the basket if desired (best shown in FIGS. 5 and 6). Holes for securing a handle generally are drilled or otherwise formed in the basket before it is removed from the basket mold 68 to reduce the risk of splitting of the top band 50. When the basket is completed, it may be removed from the mold 68.

Figure 21B:
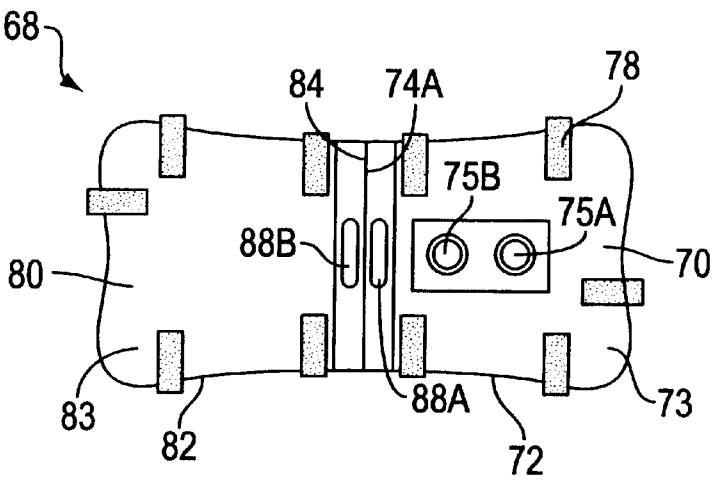
FIG. 21B is a bottom view of the mold of FIG. 21A.
Figure 21A:
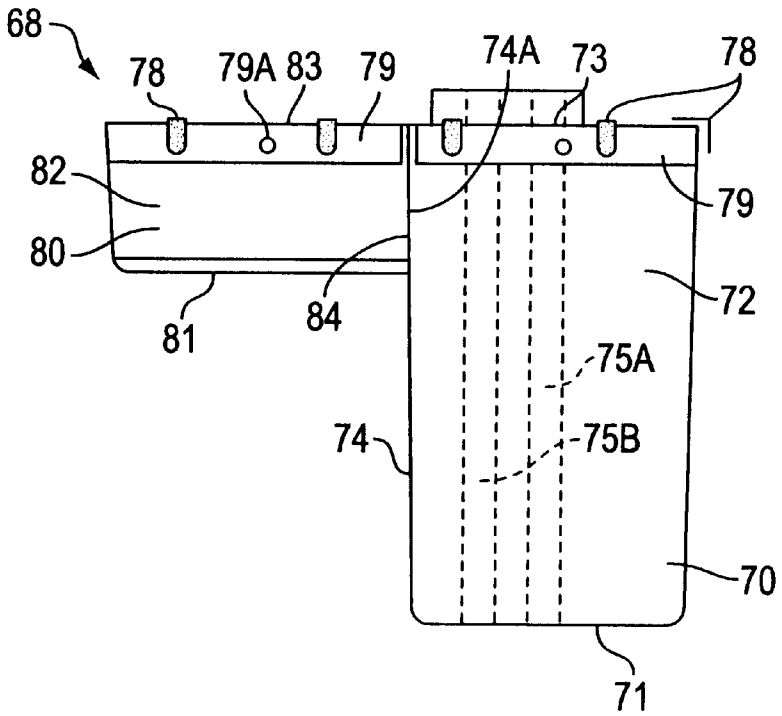
FIG. 21A is a side view of the combined mold formed by connecting the first and second mold segments.

FIGS. 18 and 21B show a vertically partitioned mold 68 for use in making a stepped-bottom basket. The combined mold 68 defines a three-dimensional L-shaped frame, best shown in FIGS. 16 and 21A. The first mold segment 70, shown in FIGS. 19A through 19E, is similar to conventional molds used in making rectangular woven baskets. The first segment 70 includes top 71 and side 72 walls that define the shape of the interior of the deep front section of the basket, and a bottom 73. Two recesses 75A, 75B (best shown in FIG. 19D) may be provided in the bottom 73 for use in supporting the mold 70 on the weaving horse. The substantially centered recess 75A is used to support the first mold 70 on the weaving horse when the first mold 70 is used alone. The second recess 75B is offset toward the back 74 of the first mold segment 70. The first mold segment 70 may be shifted on the weaving horse from the centered recess 75A to the offset recess 75B after the second mold segment 80 is added, to adjust for the new center of gravity of the combined mold 68.

The second segment 80, shown in FIGS. 20A through 20E, also includes top 81 and side 82 walls that define the shape of the interior of the shallow rear section, and a bottom 83. The top 81 of the second segment 80 (shown in FIG. 20E) may include an integral guide for forming the upper bottom panel 18. The guide defines recessed slots 86 for holding the inner reinforcements 60 in place. FIG. 15. shows an inner reinforcement 60 (partially hidden by the upsplint 30) inserted into a slot 86 on the mold 80.

When the mold 68 is partitioned vertically, the first segment 70 initially is used alone to form the lower rear panel 16 and the lower portions of the front 12, left 22 and right 24 panels. The second mold segment 80 is added to the first segment 70 for use in forming the upper bottom 18 and rear 20 panels and the remainder of the front 12 and side 22, 24 panels. It also would be possible to partition the mold 68 horizontally, i.e., with a first mold segment defining the interior of the lower bottom portion of the basket only and a second mold segment defining the interior of the entire upper portion. However, the vertically partitioned mold 68 is preferred for ease of weaving.

Figure 19A:
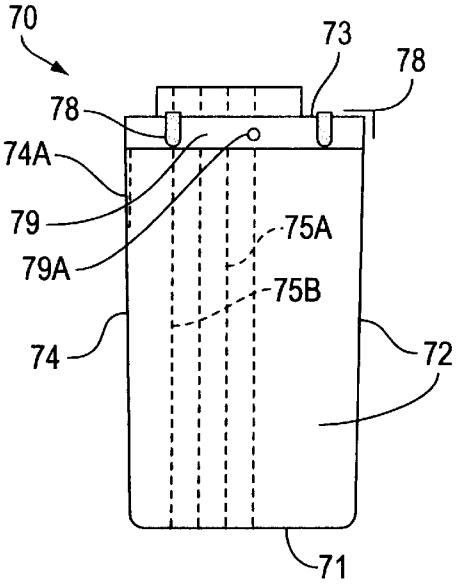
FIG. 19A is a side view of the first mold segment.
Figure 19B:
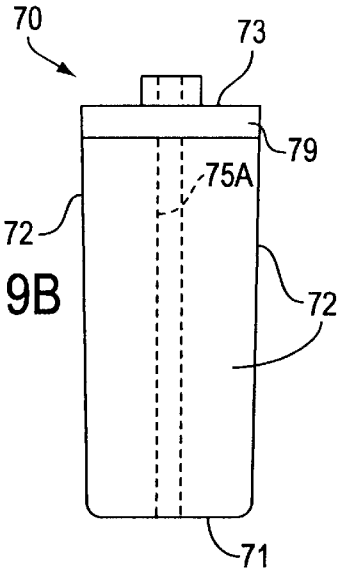
FIG. 19B is a front view of the first mold segment.
Figure 19C:
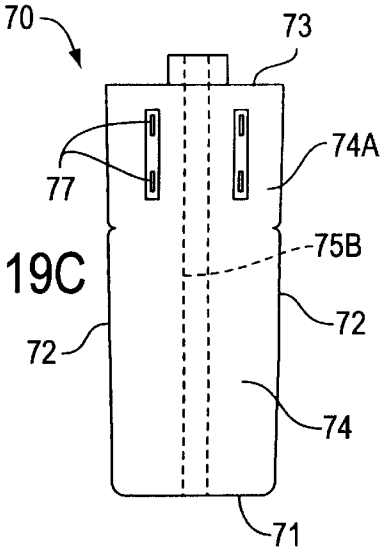
FIG. 19C is a rear view of the first mold segment.
Figure 19D:
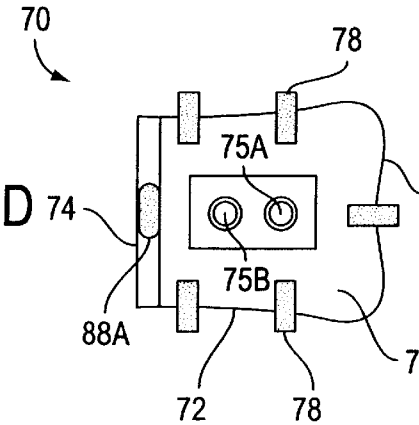
FIG. 19D is a bottom view of the first mold segment.
Figure 19E:
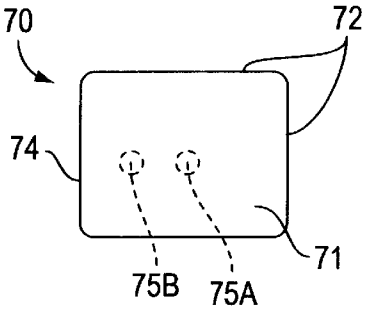
FIG. 19E is a top view of the first mold segment.
Figure 19F:
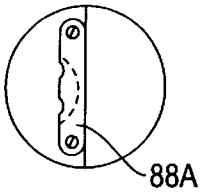
FIG. 19F is a detail view of a bottom latch of the first mold segment.
Figure 20A:
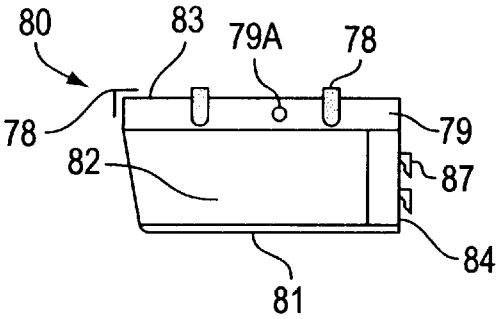
FIG. 20A is a side view of the second mold segment.
Figure 20B:
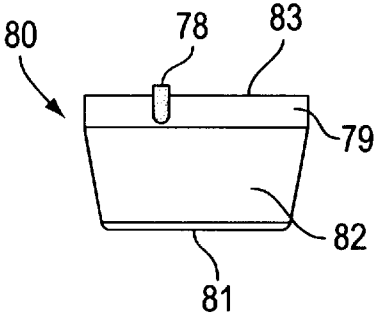
FIG. 20B is a rear view of the second mold segment.
Figure 20C:
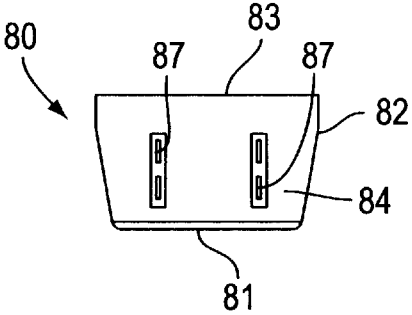
FIG. 20C is a front view of the second mold segment.
Figure 20D:
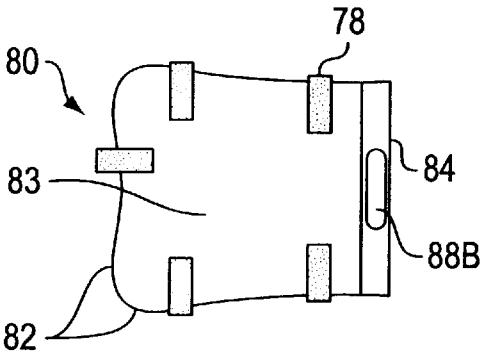
FIG. 20D is a bottom view of the second mold segment.
Figure 20E:
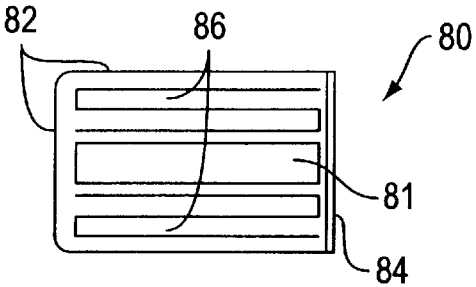
FIG. 20E is a top view of the second mold segment.
Figure 20F:
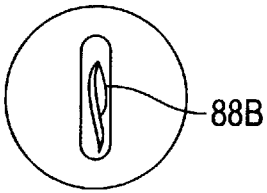
FIG. 20F is a detail view of the second mold segment.

As shown in FIGS. 18 and 21A, the front wall 84 of the second mold segment 80 may be connected to the back wall 74 of the first segment 70, with the bottoms 73, 83 of the segments aligned with one another. The upper back wall 74A of the first segment 70 is shaped for mating with the front wall 84 of the second segment 80. The front wall 84 may include a projecting notch or bracket 87 (shown in FIG. 20A) that engages a corresponding recess 77 (shown in FIG. 19C) in the upper back wall 74A of the first segment 70 to secure the mold segments together. Other methods for connecting the two segments 70, 80, such as a dovetail joint, also may be suitable if they do not alter the outer contour of the mold 68. Fasteners, such as a latch 88A, 88B, may be provided on the mold bottoms 73, 83 to hold the mold segments 70, 80 securely together as shown in FIGS. 19D, 20D, and 21B. FIGS. 21F and 22F show details of a suitable sash-type latch.

A protective band 79 may be provided along the three outer sides of each mold segment 70, 80. The band 79 covers the bottom of the exposed sides of the combined mold 68 and protects the mold 68 from damage when the splint ends are tacked to the top bands 50. The band 79 also may be provided with guides or clips 78 that hold an inner top band against the mold 68 during weaving. Bores 79A may be formed in the band 79 to guide the placement of holes to be drilled through the bands 50 and upper splint ends. These holes may be used for fastening handles, lids or other features or accessories to the basket 10.

Although a two-level stepped-bottom basket embodiment has been described in detail, other embodiments are within the scope of this invention, including a three-level basket with successively shallower bottom portions and a three-level basket with a deep center and shallow sides. Variations may be made to the described embodiment by those skilled in the art without departing from the spirit of the invention or the scope of the appended claims.

What is claimed is:

1. A splint basket with a stepped bottom, comprising:

a plurality of upsplints that define a front panel, a lower bottom panel that extends transversely from the bottom of the front panel, a lower rear panel that extends transversely from the back of the lower bottom panel and ends at a distance below the top of the front panel, an upper bottom panel that extends transversely from the top of the lower rear panel, and an upper rear panel that extends transversely from the back of the upper bottom panel;

a plurality of cross splints woven through the upsplints that define the lower bottom panel, said cross splints further defining left and right front wall portions that extend transversely from the lower bottom panel;

a plurality of horizontal splints extending around the front panel, left and right front wall portions and lower rear panel, the uppermost weave strip in the lower rear panel being woven over the outer surface of the outermost upsplints in the lower rear panel; and a plurality of short splints woven through the upsplints that define the upper bottom panel, said short splints further defining left and right rear wall portions that extend transversely from the upper bottom panel, the short splint nearest the lower rear panel being woven over the outer surface of the outermost upsplints in the upper bottom panel.

2. The basket according to claim 1, wherein the number of upsplints is selected to be an odd number.

3. The basket according to claim 1, wherein the cross splints and the short splints are spaced a substantially uniform distance from one another.

4. The basket according to claim 1, wherein the weave strips are equal in width.

5. The basket according to claim 1, further comprising:

an outer top band extending along the top rim of the basket, an end of said top band terminating at the rear of a side panel of the basket.

6. A splint basket with a stepped bottom, comprising:

a plurality of upsplints that define a front panel, a lower bottom panel that extends transversely from the bottom of the front panel, a lower rear panel that extends transversely from the back of the lower bottom panel and ends at a distance below the top of the front panel, an upper bottom panel that extends transversely from the top of the lower rear panel, and an upper rear panel that extends transversely from the back of the upper bottom panel;

a plurality of cross splints woven through the upsplints that define the lower bottom panel, said cross splints further defining left and right panels that extend transversely from the lower bottom panel;

a plurality of weave splints extending around the front, left, right and lower rear panels, the outermost upsplints in the lower rear panel being urged inwardly by the uppermost weave splint in the lower rear panel; and a plurality of short splints woven through the upsplints that define the upper bottom panel, the outermost upsplints in the upper bottom panel being urged upwardly by the short splint nearest the lower rear panel.

7. A splint basket with a stepped bottom, comprising:

a plurality of upsplints bent to define a wall panel extending transversely between an upper bottom panel and a lower bottom panel;

left and right sides connected to the wall panel, upper bottom panel and lower bottom panel;

a rear portion connected to the lower bottom panel and extending between the left and right sides;

a front portion connected to the upper bottom panel and extending between the left and right sides;

a weave strip in the wall panel positioned immediately below the upper bottom panel, said weave strip extending over the outer surface of the outermost upsplints in the wall panel; and a short splint in the upper bottom panel positioned adjacent to the wall panel, said short splint extending over the outer surface of the outermost upsplints in the upper bottom panel.

8. In a splint basket with a stepped bottom, including a plurality of upsplints that define a front panel, a lower bottom panel that extends transversely from the bottom of the front panel, a lower rear panel that extends transversely from the back of the lower bottom panel and ends at a distance below the top of the front panel, an upper bottom panel that extend transversely from the top of the lower rear panel, and an upper rear panel that extends transversely from the back of the upper bottom panel, a plurality of cross splints woven through the upsplints that define the lower bottom panel, the cross splints further defining left and right panels that extend transversely from the lower bottom panel, a plurality of horizontal splints extending around the front, left, right and lower rear panels, and a plurality of short splints woven through the upsplints that define the upper bottom panel, the improvement comprising:

the uppermost weave strip in the lower rear panel being woven over the outermost upsplints in the lower rear panel; and the short splint nearest the lower rear panel being woven over the outermost upsplints in the upper bottom panel.

* * * * *